US010692430B2

(12) United States Patent
Kim et al.

(10) Patent No.: US 10,692,430 B2
(45) Date of Patent: Jun. 23, 2020

(54) ORGANIC LIGHT EMITTING DIODE DISPLAY WITH THRESHOLD VOLTAGE COMPENSATION

(71) Applicant: LG Display Co., Ltd., Seoul (KR)

(72) Inventors: Jungchul Kim, Paju-si (KR); Junyoung Kwon, Busan (KR); Jungyoup Suk, Paju-si (KR); Heeyoung An, Bucheon-si (KR)

(73) Assignee: LG Display Co., Ltd., Seoul (KR)

( * ) Notice: Subject to any disclaimer, the term of this patent is extended or adjusted under 35 U.S.C. 154(b) by 86 days.

(21) Appl. No.: 16/109,616

(22) Filed: Aug. 22, 2018

(65) Prior Publication Data

US 2018/0366062 A1 Dec. 20, 2018

Related U.S. Application Data

(62) Division of application No. 15/162,516, filed on May 23, 2016, now abandoned.

(30) Foreign Application Priority Data

May 28, 2015 (KR) ..... 10-2015-0075335

(51) Int. Cl.
*G09G 3/3233* (2016.01)

(52) U.S. Cl.
CPC ... *G09G 3/3233* (2013.01); *G09G 2300/0819* (2013.01); *G09G 2300/0861* (2013.01);
(Continued)

(58) Field of Classification Search
None
See application file for complete search history.

(56) References Cited

U.S. PATENT DOCUMENTS 8,120,553 B2 2/2012 Kim
9,483,979 B2 11/2016 Yang
(Continued)

FOREIGN PATENT DOCUMENTS

CN 101231822 A 7/2008
CN 102629449 A 8/2012
(Continued)

OTHER PUBLICATIONS

Chinese First Office Action, Chinese Application No. 201610366192.7, dated Apr. 3, 2018, 25 pages.
(Continued)

*Primary Examiner* — Amr A Awad
*Assistant Examiner* — Donna V Lui
(74) *Attorney, Agent, or Firm* — Fenwick & West LLP

(57) ABSTRACT

In pixels included in a display panel of an light emitting diode display, each pixel on an nth pixel row, where n is a natural number, includes a light emitting diode including an anode electrode connected to a node C and a cathode electrode connected to an input terminal of a low potential driving voltage, a driving TFT including a gate electrode connected to a node A, a drain electrode connected to a node B, and a source electrode connected to a node D, a first TFT connected between the node A and the node B, a second TFT connected to the node C, a third TFT connected between a data line and the node D, a fourth TFT connected between an input terminal of a high potential driving voltage and the node B, and a fifth TFT connected between the node D and the node C.

4 Claims, 32 Drawing Sheets

(52) U.S. Cl.
CPC ..... *G09G 2310/0251* (2013.01); *G09G 2310/0262* (2013.01); *G09G 2320/043* (2013.01)

(56) References Cited

U.S. PATENT DOCUMENTS

| | | | | |
|---|---|---|---|---|
| 9,495,907 | B2 | 11/2016 | Han | |
| 9,501,170 | B2 | 11/2016 | Wu et al. | |
| 9,812,082 | B2 | 11/2017 | Chen et al. | |
| 9,824,629 | B2 | 11/2017 | Nie | |
| 9,953,569 | B2 | 4/2018 | Mu et al. | |
| 2003/0132931 | A1 | 7/2003 | Kimura et al. | |
| 2005/0093791 | A1 | 5/2005 | Lo | |
| 2008/0180364 | A1 | 7/2008 | Kim | |
| 2009/0289876 | A1 | 11/2009 | Chun | |
| 2011/0254883 | A1 | 10/2011 | Tsai et al. | |
| 2014/0175992 | A1 | 7/2014 | Yang | |
| 2015/0220201 | A1 | 8/2015 | Wu et al. | |
| 2016/0063921 | A1 | 3/2016 | Tsai et al. | |
| 2016/0155387 | A1* | 6/2016 | Kim | G09G 3/3291 345/76 |
| 2016/0189606 | A1 | 6/2016 | Chen et al. | |
| 2016/0240136 | A1 | 8/2016 | Han | |
| 2016/0284280 | A1 | 9/2016 | Mu et al. | |
| 2016/0300526 | A1* | 10/2016 | Lim | G09G 3/3233 |
| 2016/0307502 | A1 | 10/2016 | Nie | |
| 2016/0314742 | A1* | 10/2016 | Zhou | G09G 3/3258 |

FOREIGN PATENT DOCUMENTS

| | | | |
|---|---|---|---|
| CN | 103000134 | A | 3/2013 |
| CN | 202855269 | U | 4/2013 |
| CN | 103325343 | A | 9/2013 |
| CN | 103996379 | A | 8/2014 |
| CN | 104282266 | A | 1/2015 |
| CN | 104318897 | A | 1/2015 |
| CN | 104465715 | A | 3/2015 |
| CN | 104575377 | A | 4/2015 |
| CN | 104658483 | A | 5/2015 |

OTHER PUBLICATIONS

United States Office Action, U.S. Appl. No. 15/162,516, dated May 31, 2018, 17 pages.
China National Intellectual Property Administration, Office Action, CN Patent Application No. 201610366192.7, dated Dec. 2, 2019, 17 pages.
China National Intellectual Property Second Office Action, Patent Application No. 201610366192.7, dated Nov. 28, 2018, 32 pages.
China National Intellectual Property Search Report, Patent Application No. 201610366192.7, dated Apr. 3, 2018, 2 pages.

* cited by examiner

FIG. 6

| | Pi | Ps | Pe |
|---|---|---|---|
| A | ELVDD | Vdata(n)+Vth | Vdata(n)+Vth+Voled-Vinit |
| D | Vdata(n) of previous frame | Vdata(n) | Voled |
| C | Vinit | Vinit | Voled |

ORGANIC LIGHT EMITTING DIODE DISPLAY WITH THRESHOLD VOLTAGE COMPENSATION

CROSS REFERENCE TO RELATED APPLICATIONS

This application is a divisional application of U.S. patent application Ser. No. 15/162,516 filed on May 23, 2016, which claims the benefit of Korean Patent Application No. 10-2015-0075335 filed on May 28, 2015, which is incorporated herein by reference for all purposes as if fully set forth herein.

BACKGROUND OF THE INVENTION

Field of the Invention

The present disclosure relates to an organic light emitting diode (OLED) display.

Discussion of the Related Art

An active matrix organic light emitting diode (OLED) display includes organic light emitting diodes (OLEDs) capable of emitting light by itself and has advantages of a fast response time, a high emission efficiency, a high luminance, a wide viewing angle, and the like.

An OLED serving as a self-emitting element has a structure shown in FIG. 1. The OLED includes an anode electrode, a cathode electrode, and an organic compound layer between the anode electrode and the cathode electrode. The organic compound layer includes a hole injection layer HIL, a hole transport layer HTL, an emission layer EML, an electron transport layer ETL, and an electron injection layer EIL. When a driving voltage is applied to the anode electrode and the cathode electrode, holes passing through the hole transport layer HTL and electrons passing through the electron transport layer ETL move to the emission layer EML and form excitons. As a result, the emission layer EML generates visible light.

The OLED display arranges pixels each including an OLED in a matrix form and adjusts a luminance of the pixels based on a gray scale of video data. Each pixel includes a driving thin film transistor (TFT) controlling a driving current flowing in the OLED based on a gate-to-source voltage of the driving TFT, a capacitor for uniformly holding the gate-to-source voltage of the driving TFT during one frame, and at least one switching TFT programming the gate-to-source voltage of the driving TFT in response to a gate signal. The driving current flowing in the OLED is determined by a threshold voltage of the driving TFT and the gate-to-source voltage of the driving TFT controlled based on a data voltage. The luminance of the pixel is proportional to a magnitude of the driving current.

In the OLED display, the driving TFTs of the pixels may have different threshold voltages by reason of a process variation, a gate-bias stress resulting from the elapse of driving time, etc. Because the luminance of the pixel is proportional to the magnitude of the driving current as mentioned above, a variation in the threshold voltage of the driving TFTs of the pixels leads to a luminance variation of the pixels.

SUMMARY OF THE INVENTION

The present disclosure provides an organic light emitting diode (OLED) display capable of improving display quality by compensating for a variation in a threshold voltage of pixels.

In one aspect, there is provided an organic light emitting diode display comprising a display panel including a plurality of pixels, wherein each pixel includes an organic light emitting diode (OLED) including an anode electrode connected to a node C and a cathode electrode connected to an input terminal of a low potential driving voltage, a driving thin film transistor (TFT) including a gate electrode connected to a node A, a drain electrode connected to a node B, and a source electrode connected to a node D, the driving TFT being configured to control a driving current applied to the OLED, a first TFT connected between the node A and the node B, a second TFT connected to the node C, a third TFT connected between the data line and the node D, a fourth TFT connected between an input terminal of a high potential driving voltage and the node B, a fifth TFT connected between the node D and the node C, and a storage capacitor connected between the node A and the node C.

In another aspect, there is provided an organic light emitting diode display comprising a display panel including a plurality of pixels wherein each pixel includes an organic light emitting diode (OLED) including an anode electrode connected to a node C and a cathode electrode connected to an input terminal of a low potential driving voltage, a driving thin film transistor (TFT) including a gate electrode connected to a node A, a drain electrode connected to a node B, and a source electrode connected to a node D, the driving TFT being configured to control a driving current applied to the OLED, a first TFT connected between the node A and the node B, a second TFT connected to the node C, a third TFT connected between the data line and the node D, a fourth TFT connected between an input terminal of a high potential driving voltage and the node B, a fifth TFT connected between the node D and the node C, and a storage capacitor connected between the node A and an input terminal of an initialization voltage.

In yet another aspect, there is provided an organic light emitting diode display comprising a display panel including a plurality of pixels wherein each pixel includes an organic light emitting diode (OLED) including an anode electrode connected to a node C and a cathode electrode connected to an input terminal of a low potential driving voltage, a driving thin film transistor (TFT) including a gate electrode connected to a node A, a drain electrode connected to a node B, and a source electrode connected to a node D, the driving TFT being configured to control a driving current applied to the OLED, a first TFT connected between the node A and the node B, a third TFT connected between the data line and the node D, a fourth TFT connected between an input terminal of a high potential driving voltage and the node B, a fifth TFT connected between the node D and the node C, and a storage capacitor connected to the node A.

BRIEF DESCRIPTION OF THE DRAWINGS

The accompanying drawings, which are included to provide a further understanding of the invention and are incorporated in and constitute a part of this specification, illustrate embodiments of the invention and together with the description serve to explain the principles of the invention. In the drawings:

FIG. 6 shows voltage values of a pixel at nodes A, D, and C in an initial period, a sampling period, and an emission period;

DETAILED DESCRIPTION OF THE ILLUSTRATED EMBODIMENTS

Reference will now be made in detail to various embodiments, examples of which are illustrated in the accompanying drawings. Wherever possible, the same reference numbers will be used throughout the drawings to refer to the same or like parts. Detailed description of known arts will be omitted if it is determined that the arts can obscure the description of the various embodiments. In on Embodiment, all of thin film transistors (TFTs) constituting a pixel are implemented as n-type TFTs. In other embodiments, other configurations may be used. For example, TFTs constituting a pixel may be implemented as p-type TFTs.

Figure 2:
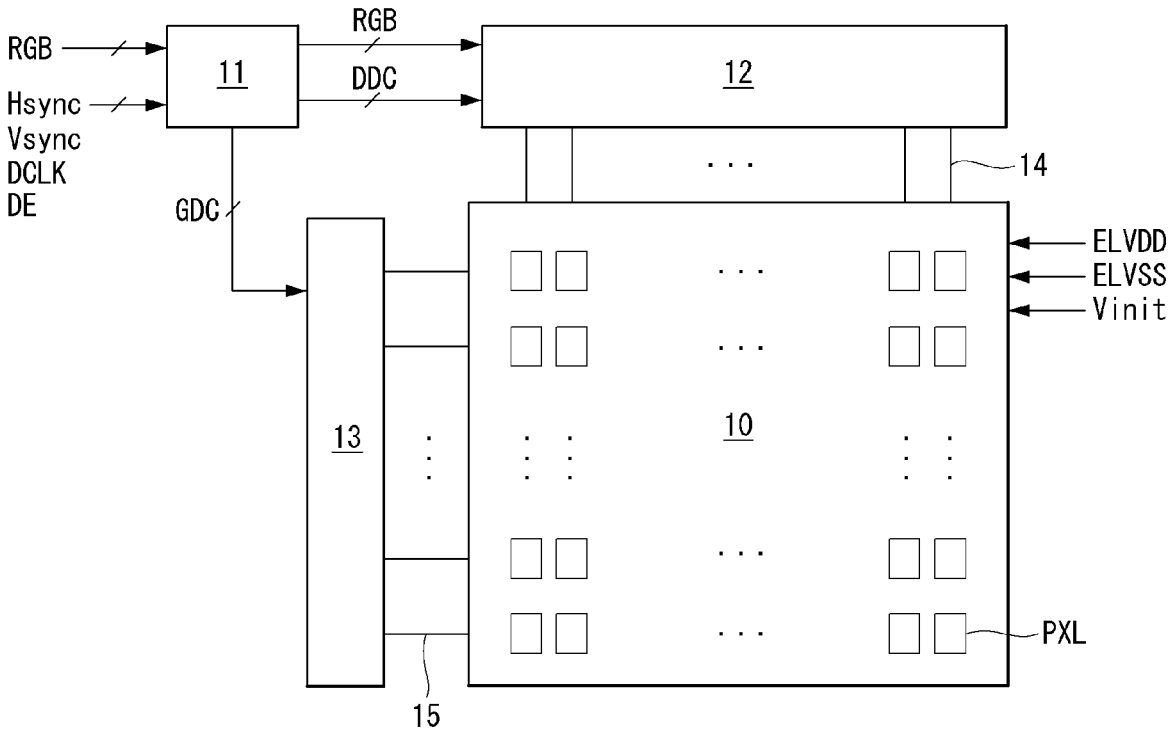
FIG. 2 shows an organic light emitting diode (OLED) display according to an embodiment.

FIG. 2 shows an organic light emitting diode (OLED) display according to an embodiment.

Referring to FIG. 2, an OLED display according to an embodiment includes a display panel 10 on which pixels PXL are formed, a data driving circuit 12 for driving data lines 14 of the display panel 10, a gate driving circuit 13 for driving gate lines 15 of the display panel 10, and a timing controller 11 for controlling driving timing of the data driving circuit 12 and the gate driving circuit 13.

On the display panel 10, the plurality of data lines 14 and the plurality of gate lines 15 cross each other, and the pixels PXL are respectively disposed at crossings of the data lines 14 and the gate lines 15 in a matrix form. The pixels PXL on the same horizontal line form one pixel row. The pixels PXL on one pixel row are connected to one gate line 15. One gate line 15 may include at least one scan line and at least one emission line. Each pixel PXL may be connected to one data line 14, at least one scan line, and at least one emission line. The pixels PXL may commonly receive a high potential driving voltage ELVDD, a low potential driving voltage ELVSS, and an initialization voltage Vinit from a power generator (not shown). In one embodiment, the initialization voltage Vinit is selected within a range sufficiently less than an operating voltage of an organic light emitting diode (OLED) so that an OLED of each pixel PXL is prevented from emitting light during an initial period and a sampling period. Further, the initialization voltage Vinit may be set to be equal to or less than the low potential driving voltage ELVSS.

Thin film transistors (TFTs) constituting the pixel PXL may be implemented as an oxide TFT including an oxide semiconductor layer. The oxide TFT is advantageous for the large area of the display panel 10 considering all of an electron mobility, a process variation, etc. The embodiments are not limited thereto. For example, the semiconductor layer of the TFT may be formed of amorphous silicon or polycrystalline silicon.

Each pixel PXL includes a plurality of TFTs for compensating for changes in a threshold voltage of a driving TFT and a storage capacitor. The embodiments propose a pixel structure capable of increasing integration of the pixels and easily compensating for an IR drop of the high potential driving voltage. The pixel structure is described in detail later with reference to FIGS. 3 to 28.

Figure 3:
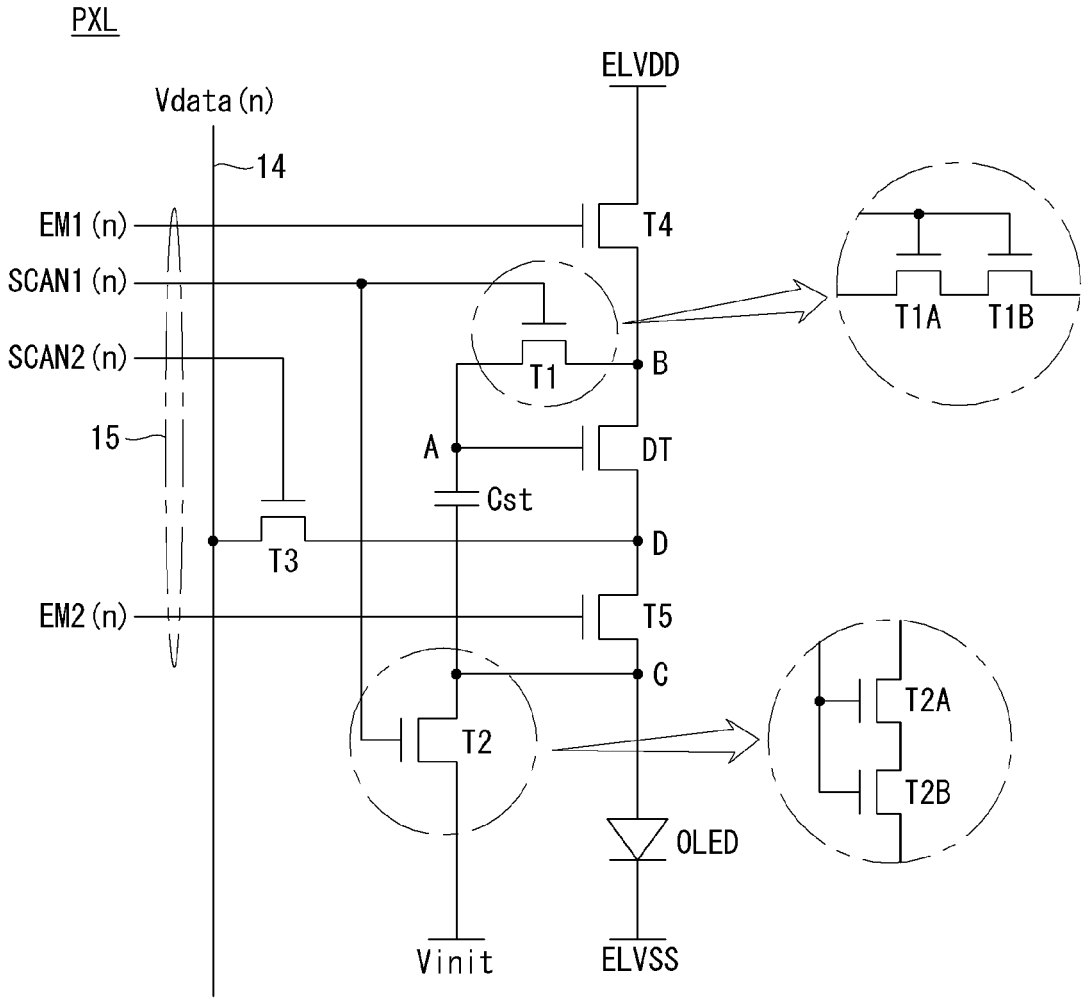
FIG. 3 is an equivalent circuit diagram showing a structure of a pixel according to an embodiment.
Figure 24:
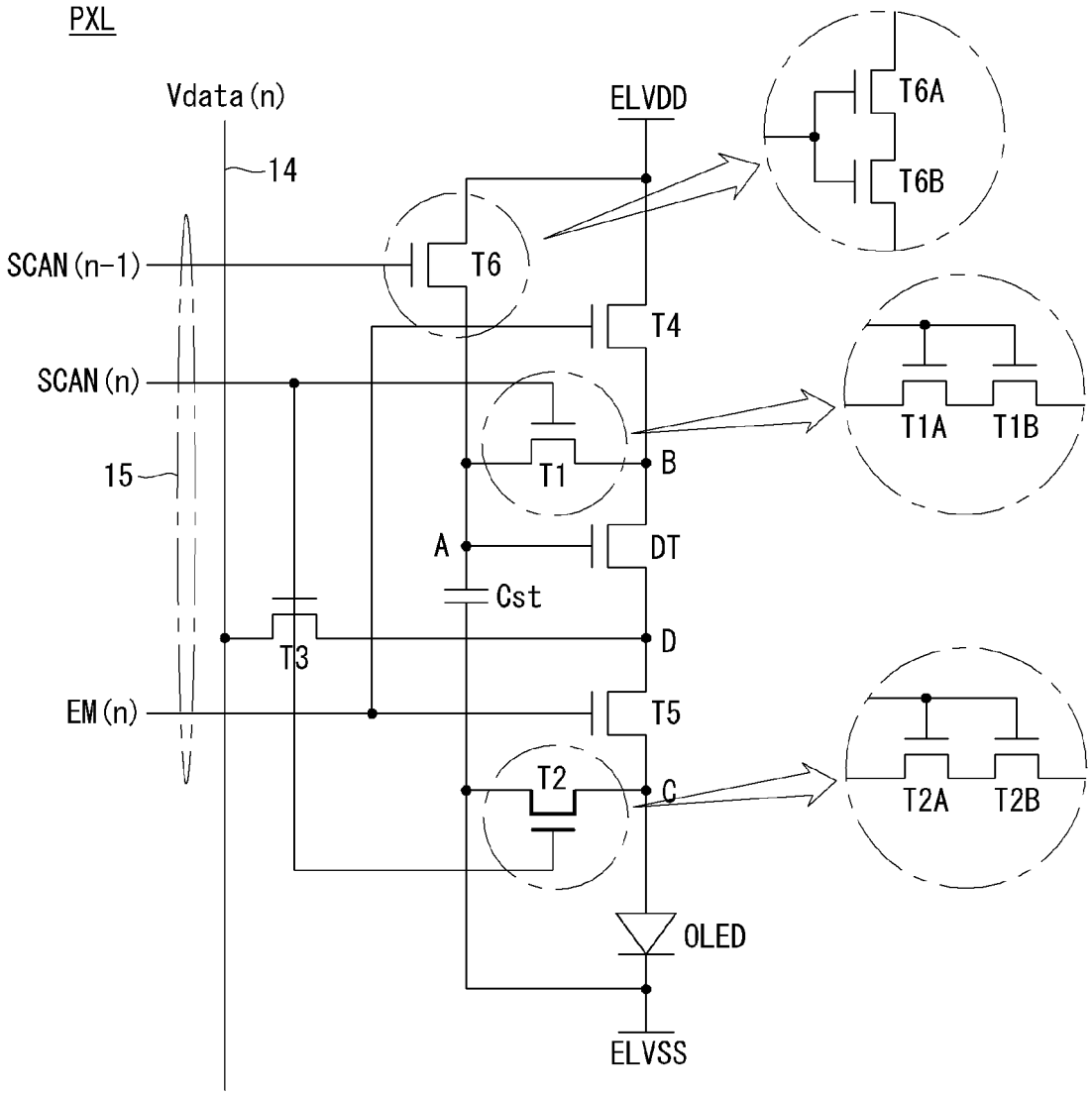

Each pixel PXL may be configured such that a TFT, of which a source electrode or a drain electrode is connected to an electrode on one side of the storage capacitor, includes at least two TFTs, which are connected in series to each other, so as to reduce or prevent an influence of a leakage current. In this instance, at least two TFTs are turned on or off in response to the same control signal. For example, as shown in FIG. 3, a TFT T1 may be designed as a double gate TFT including TFTs T1A and T1B which are turned on or off in response to the same control signal and are connected in series to each other, and a TFT T2 may be designed as a double gate TFT including TFTs T2A and T2B which are turned on or off in response to the same control signal and are connected in series to each other. Further, as shown in FIG. 24, in addition to the TFTs T1 and T2, a TFT T6 may be designed as a double gate TFT including TFTs T6A and T6B.

The timing controller 11 rearranges digital video data RGB received from the outside in conformity with a resolution of the display panel 10 and supplies the rearranged digital video data RGB to the data driving circuit 12. The timing controller 11 generates a data control signal DDC for controlling operation timing of the data driving circuit 12 and a gate control signal GDC for controlling operation timing of the gate driving circuit 13 based on timing signals, such as a vertical sync signal Vsync, a horizontal sync signal Hsync, a dot clock DCLK, and a data enable signal DE.

The data driving circuit 12 converts the digital video data RGB received from the timing controller 11 into an analog data voltage based on the data control signal DDC.

The gate driving circuit 13 may generate a scan signal and an emission signal based on the gate control signal GDC. The gate driving circuit 13 may include a scan driver and an emission driver. The scan driver may generate a scan signal in a sequential line manner so as to drive at least one scan line connected to each pixel row and may supply the scan signal to the scan lines. The emission driver may generate an emission signal in the sequential line manner so as to drive at least one emission line connected to each pixel row and may supply the emission signal to the emission lines.

The gate driving circuit 13 may be directly formed on a non-display area of the display panel 10 through a gate driver-in panel (GIP) process.

FIG. 3 is an equivalent circuit diagram showing a structure of a pixel according to an embodiment.

Referring to FIG. 3, each pixel PXL on an nth pixel row, where n is a natural number, includes an OLED, a driving TFT DT, a first TFT T1, a second TFT T2, a third TFT T3, a fourth TFT T4, a fifth TFT T5, and a storage capacitor Cst. Each pixel PXL on the nth pixel row operates in response to an nth gate signal. The nth gate signal includes an nth first scan signal SCAN1(*n*), an nth second scan signal SCAN2(*n*), an nth first emission signal EM1(*n*), and an nth second emission signal EM2(*n*).

Figure 1:
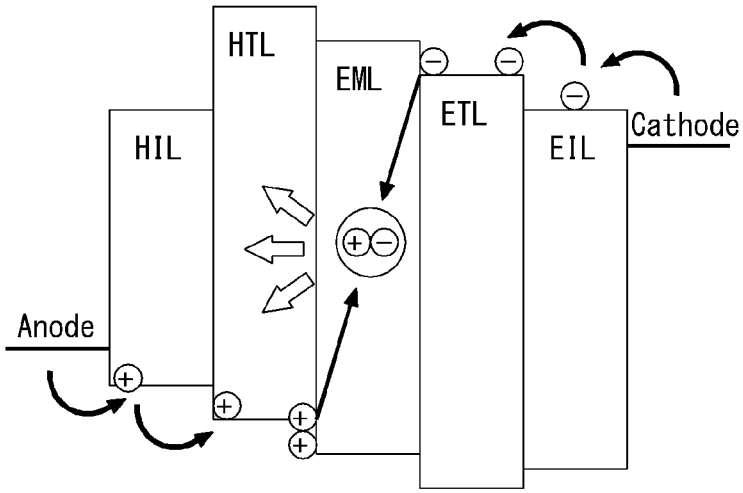
FIG. 1 (RELATED ART)
FIG. 1 illustrates an organic light emitting diode (OLED) and an emission principle of the OLED.

The OLED emits light using a driving current Ioled supplied from the driving TFT DT. As shown in FIG. 1, the OLED includes an anode electrode, a cathode electrode, and a multi-layered organic compound layer between the anode electrode and the cathode electrode. The multi-layered organic compound layer includes a hole injection layer HIL, a hole transport layer HTL, an emission layer EML, an electron transport layer ETL, and an electron injection layer EIL. The anode electrode of the OLED is connected to a node C, and the cathode electrode of the OLED is connected to an input terminal of the low potential driving voltage ELVSS.

The driving TFT DT controls the driving current Ioled applied to the OLED depending on a gate-to-source voltage Vgs of the driving TFT DT. A gate electrode of the driving TFT DT is connected to a node A, and a drain electrode of the driving TFT DT is connected to a node B. A source electrode of the driving TFT DT is connected to the node C.

The first TFT T1 is connected between the node A and the node B and is turned on or off in response to the nth first scan signal SCAN1(*n*). A gate electrode of the first TFT T1 is connected to a first scan line (hereinafter, referred to as "nth first scan line") of the nth pixel row, to which the nth first scan signal SCAN1(*n*) is applied. A drain electrode of the first TFT T1 is connected to the node B, and a source electrode of the first TFT T1 is connected to the node A.

The second TFT T2 is connected between the node C and an input terminal of the initialization voltage Vinit and is turned on or off in response to the nth first scan signal SCAN1(*n*). A gate electrode of the second TFT T2 is connected to the nth first scan line, to which the nth first scan signal SCAN1(*n*) is applied. A drain electrode of the second TFT T2 is connected to the node C, and a source electrode of the second TFT T2 is connected to the input terminal of the initialization voltage Vinit.

The third TFT T3 is connected between the data line 14 and a node D and is turned on or off in response to the nth second scan signal SCAN2(*n*). A gate electrode of the third TFT T3 is connected to a second scan line (hereinafter, referred to as "nth second scan line") of the nth pixel row, to which the nth second scan signal SCAN2(*n*) is applied. A drain electrode of the third TFT T3 is connected to the data line 14, and a source electrode of the third TFT T3 is connected to the node D.

The fourth TFT T4 is connected between an input terminal of the high potential driving voltage ELVDD and the node B and is turned on or off in response to the nth first emission signal EM1(*n*). A gate electrode of the fourth TFT T4 is connected to a first emission line (hereinafter, referred to as "nth first emission line") of the nth pixel row, to which the nth first emission signal EM1(*n*) is applied. A drain electrode of the fourth TFT T4 is connected to the input terminal of the high potential driving voltage ELVDD, and a source electrode of the fourth TFT T4 is connected to the node B.

The fifth TFT T5 is connected between the node D and the node C and is turned on or off in response to the nth second emission signal EM2(*n*). A gate electrode of the fifth TFT T5 is connected to a second emission line (hereinafter, referred to as "nth second emission line") of the nth pixel row, to which the nth second emission signal EM2(*n*) is applied. A drain electrode of the fifth TFT T5 is connected to the node D, and a source electrode of the fifth TFT T5 is connected to the node C.

The storage capacitor Cst is connected between the node A and the node C.

An operation of the pixel PXL shown in FIG. 3 is described below with reference to FIGS. 4, 5A to 5C, and 6.

Figure 4:
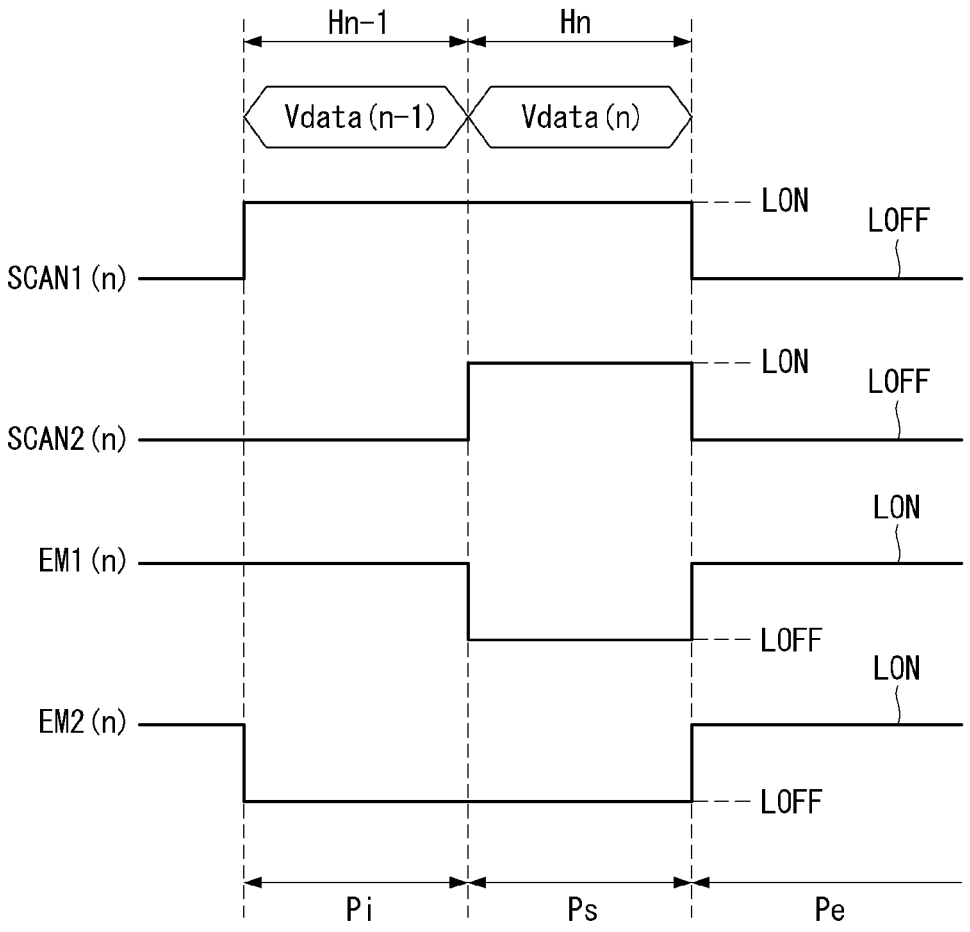
FIG. 4 is a waveform diagram showing a data signal and a gate signal applied to a pixel shown in FIG. 3.

FIG. 4 is a waveform diagram showing a data signal and a gate signal applied to a pixel shown in FIG. 3. As shown in FIG. 4, one frame period may be divided into an initial period Pi in which the node A and the node C are initialized, a sampling period Ps in which a threshold voltage Vth of the driving TFT DT is sampled and is stored in the node A, and an emission period Pe in which the gate-to-source voltage Vgs of the driving TFT DT is programmed to include the sampled threshold voltage Vth, and the OLED emits light using the driving current Ioled of the OLED controlled based on the programmed gate-to-source voltage Vgs. As shown in FIG. 4, because an initialization operation is performed during a (n−1)th horizontal period (Hn−1), an entire duration of an nth horizontal period Hn can be allotted to a sampling operation. When the sampling period Ps is sufficiently secured as described above, the threshold voltage Vth of the driving TFT DT can be sampled more accurately.

Figure 5A:
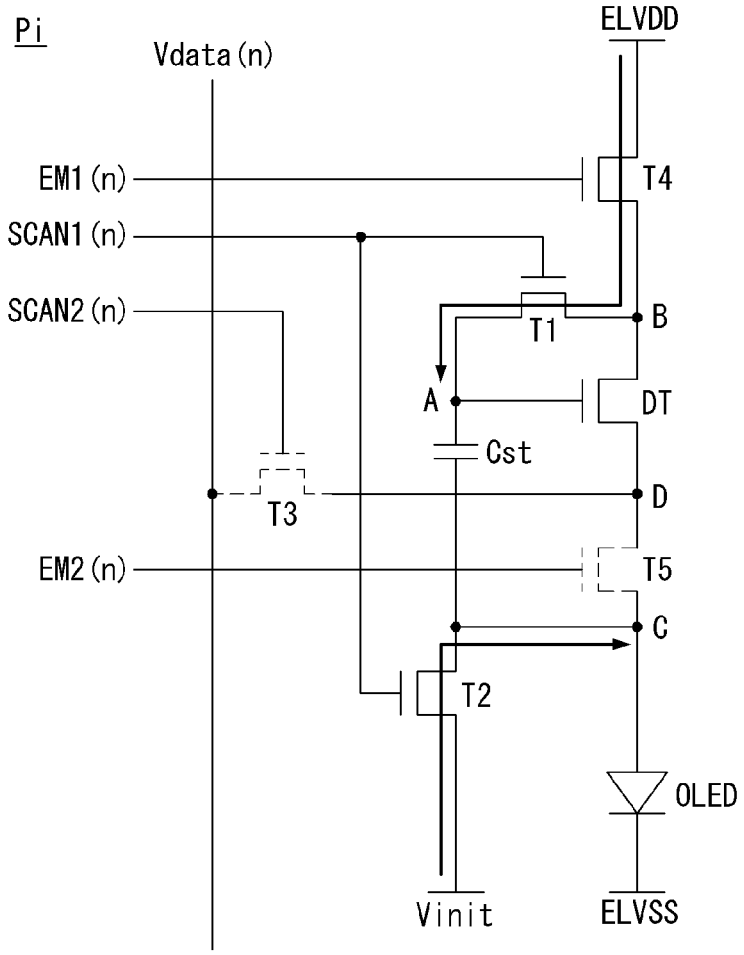
FIGS. 5A, 5B, and 5C respectively show equivalent circuit diagrams of a pixel corresponding to an initial period, a sampling period, and an emission period of FIG. 4.

More specifically, referring to FIG. 5A, the initial period Pi is included in the (n−1)th horizontal period (Hn−1) allotted in writing data on a (n−1)th pixel row. In the initial period Pi, the nth first scan signal SCAN1(*n*) and the nth first emission signal EM1(*n*) are applied at an on-level, and the nth second scan signal SCAN2(*n*) and the nth second emission signal EM2(*n*) are applied at an off-level. In the initial period Pi, the first and second TFTs T1 and T2 are turned on in response to the nth first scan signal SCAN1(*n*), and the fourth TFT T4 is turned on in response to the nth first emission signal EM1(*n*). Hence, the node A is initialized to the high potential driving voltage ELVDD, and the node C is initialized to the initialization voltage Vinit. A reason to initialize the nodes A and C before the sampling operation is to increase reliability of the sampling operation and prevent the OLED from emitting light. For this, in one embodiment, the initialization voltage Vinit is selected within a range sufficiently less than an operating voltage of the OLED. Further, the initialization voltage Vinit may be set to be equal to or less than the low potential driving voltage ELVSS. In the initial period Pi, the node D is held at a data voltage Vdata(n) of a previous frame.

Figure 5B:
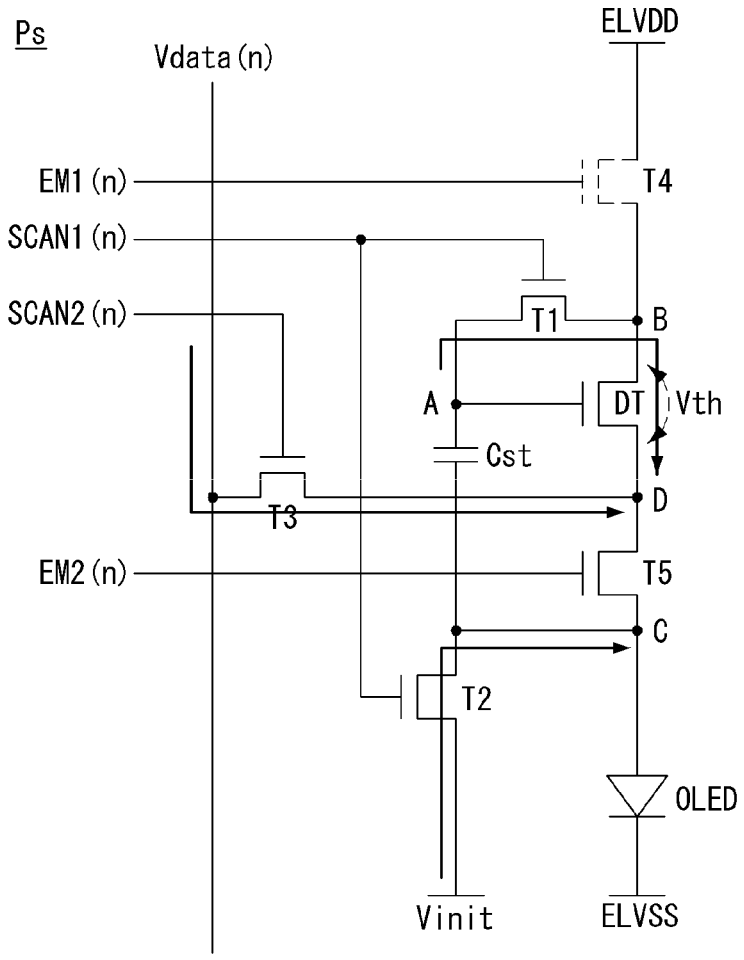

Referring to FIG. 5B, the sampling period Ps is included in the nth horizontal period Hn allotted in writing data on the nth pixel row. In the sampling period Ps, the nth first scan signal SCAN1(*n*) and the nth second scan signal SCAN2(*n*) are applied at an on-level, and the nth first emission signal EM1(*n*) and the nth second emission signal EM2(*n*) are applied at an off-level. In the sampling period Ps, the first and second TFTs T1 and T2 are turned on in response to the nth first scan signal SCAN1(*n*), and the third TFT T3 is turned on in response to the nth second scan signal SCAN2(*n*). Hence, the driving TFT DT is diode-connected. Namely, the gate electrode and the drain electrode of the driving TFT DT are short-circuited, and thus the driving TFT DT operates like a diode. Further, the data voltage Vdata(n) is applied to the node D. In the embodiment disclosed herein, the data voltage Vdata(n) is applied at a sufficiently low voltage (for example, Vdata(n)<ELVDD-Vth), so that the driving TFT DT can be turned on during the sampling period Ps. In the sampling period Ps, a current Ids flows between the drain electrode and the source electrode of the driving TFT DT, and a voltage of the node A is reduced from the high potential driving voltage ELVDD of an initial state to a sum (Vdata(n)+Vth) of the data voltage Vdata(n) and the threshold voltage Vth of the driving TFT DT due to the current Ids. In the sampling period Ps, a voltage of the node C is held at the initialization voltage Vinit and provides a path of the current Ids.

Figure 5C:
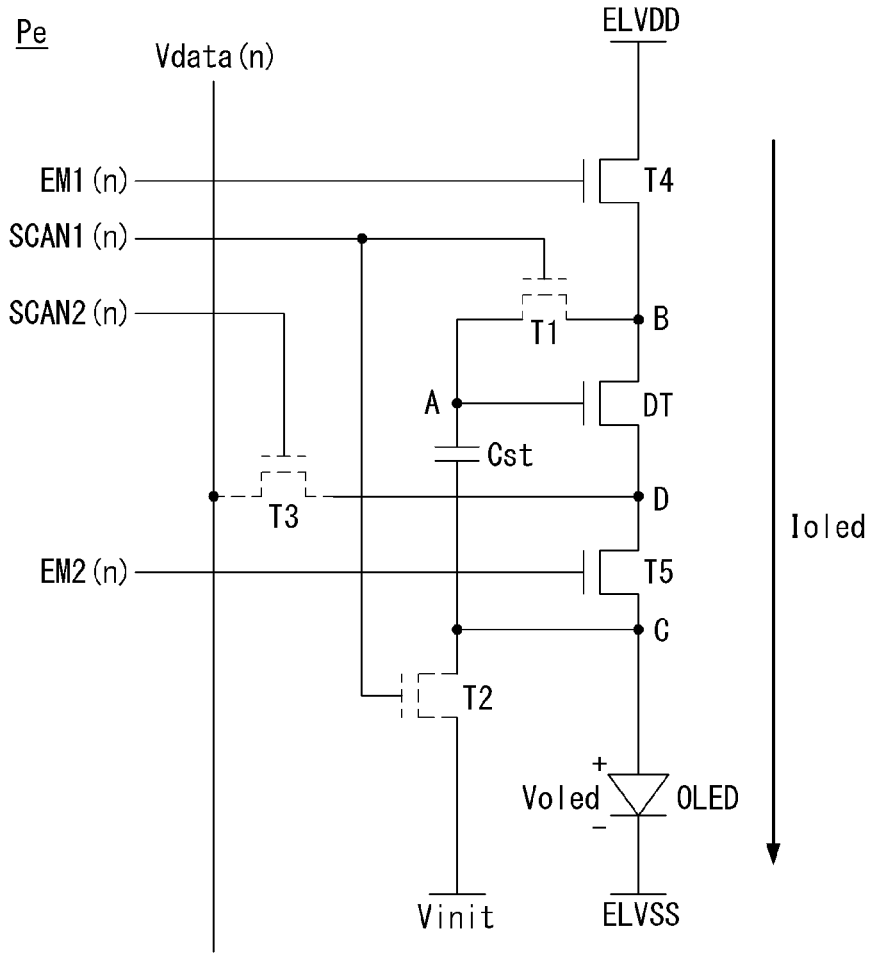

Referring to FIG. 5C, the emission period Pe corresponds to a remaining period excluding the initial period Pi and the sampling period Ps from one frame period. In the emission period Pe, the nth first emission signal EM1(*n*) and the nth second emission signal EM2(*n*) are applied at an on-level, and the nth first scan signal SCAN1(*n*) and the nth second scan signal SCAN2(*n*) are applied at an off-level. In the emission period Pe, the fourth TFT T4 is turned on in response to the nth first emission signal EM1(*n*), and thus the drain electrode of the driving TFT DT is connected to the input terminal of the high potential driving voltage ELVDD. Further, the fifth TFT T5 is turned on in response to the nth second emission signal EM2(*n*), and thus the nodes C and D have the same voltage as an operating voltage Voled of the OLED. In the emission period Pe, the voltage of the node C is changed from the initialization voltage Vinit of an initial state to the operating voltage Voled of the OLED. In the emission period Pe, because the node A is floated and is coupled with the node C through the storage capacitor Cst, the voltage of the node A is changed from the voltage (Vdata(n)+Vth) of the node A, which is set during the sampling period Ps, by a voltage variance (Voled−Vinit) of the node C. Namely, in the emission period Pe, the voltage of the node A is set to "Vdata(n)+Vth+Voled−Vinit", and the voltage of the node C is set to the operating voltage Voled of the OLED. Hence, the gate-to-source voltage Vgs subtracting a source voltage Vs from a gate voltage Vg of the driving TFT DT is programmed to "Vdata(n)+Vth−Vinit".

A relationship equation with respect to the driving current Ioled flowing in the OLED in the emission period Pe is represented by the following Equation 1. The OLED emits light using the driving current Ioled and implements a desired gray level.

$$Ioled = \frac{k}{2}[(Vgs - Vth)]^2 = \frac{k}{2}[Vdata(n) - Vinit]^2 \quad \text{[Equation 1]}$$

In the above Equation 1, "k" is a proportional constant determined by an electron mobility, a parasitic capacitance, and a channel capacity, etc. of the driving TFT DT.

According to the above Equation 1, the driving current Ioled is represented by $k/2(Vgs-Vth)^2$. However, because the threshold voltage Vth of the driving TFT DT is included in the gate-to-source voltage Vgs programmed in the emission period Pe, the threshold voltage Vth of the driving TFT DT is cancelled from the relationship equation of the driving current Ioled as indicated by the above Equation 1. Namely, an influence of changes in the threshold voltage Vth on the driving current Ioled is removed.

There is an IR drop variation as another cause hindering the luminance uniformity of the OLED display. The IR drop variation generates a variation in the high potential driving voltage ELVDD applied to each pixel. However, because the component of the high potential driving voltage ELVDD is not included in the driving current Ioled represented by the above Equation 1 through the distinguishing configuration shown in FIGS. 3 to 6, the embodiment can reduce an influence of the IR drop variation on the driving current Ioled.

Figure 7:
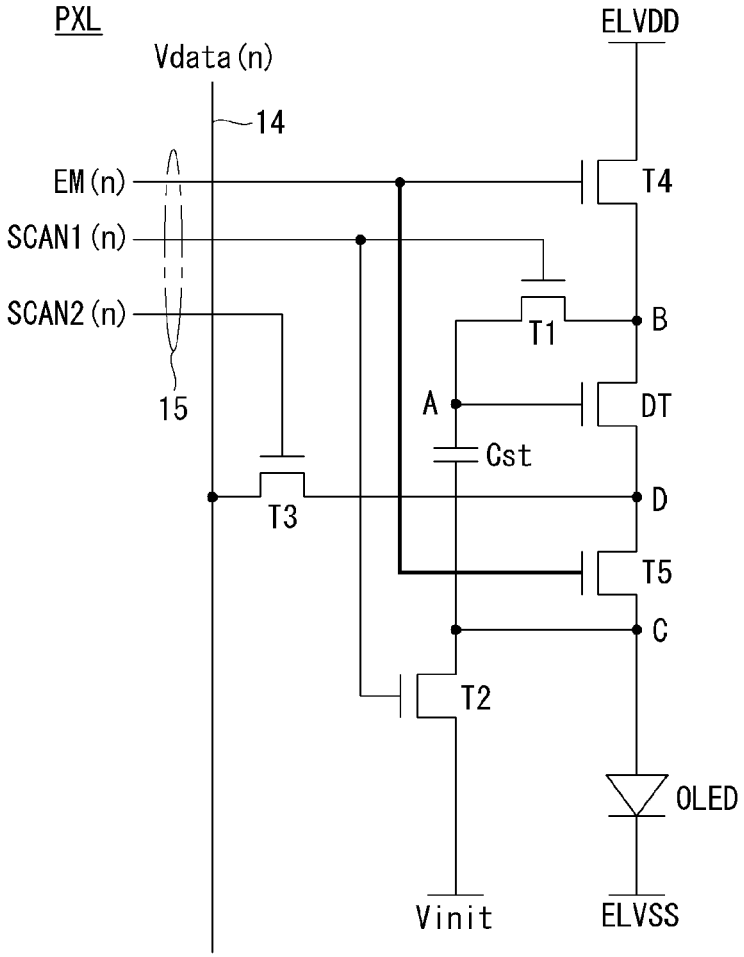
FIGS. 7 and 8 are equivalent circuit diagrams showing modified examples of a pixel structure shown in FIG. 3.
Figure 8:
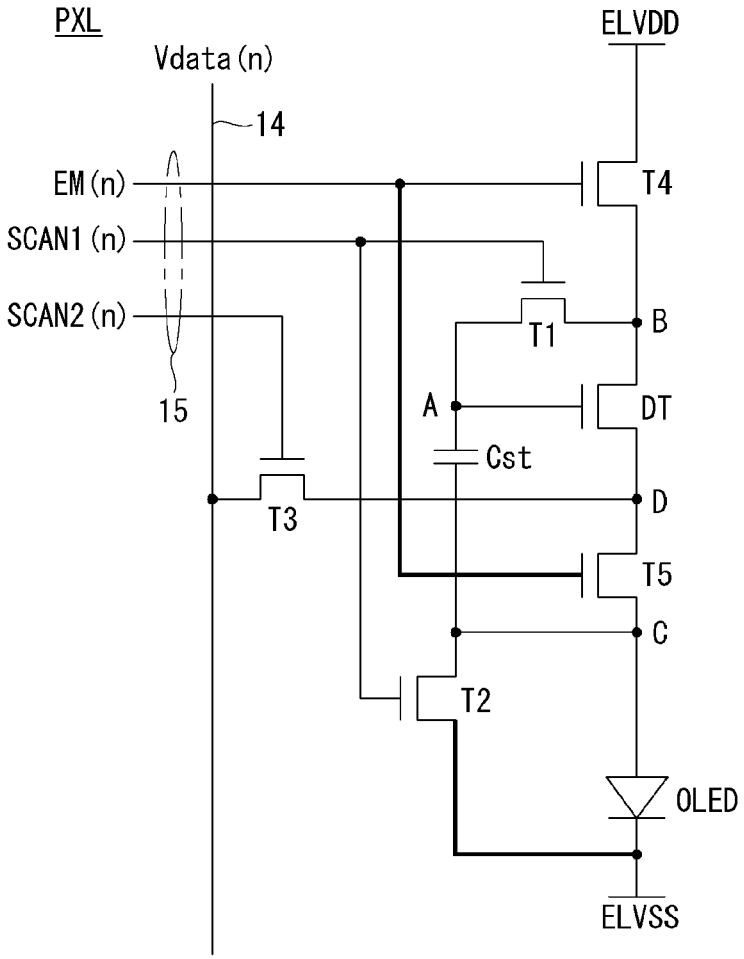
Figure 9:
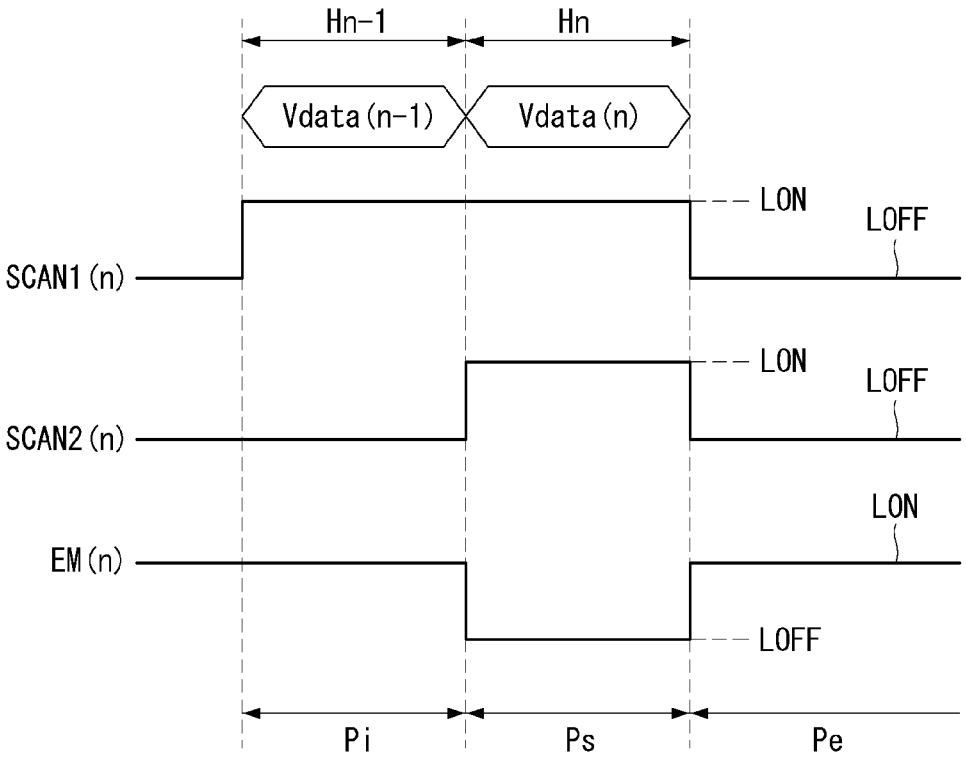
FIG. 9 is a waveform diagram showing a data signal and a gate signal applied to a pixel shown in FIGS. 7 and 8.

FIGS. 7 and 8 are equivalent circuit diagrams showing modified examples of a pixel structure shown in FIG. 3. FIG. 9 is a waveform diagram showing a data signal and a gate signal applied to a pixel shown in FIGS. 7 and 8.

Simplifying a pixel array of the display panel 10 simplifies the manufacturing process of the display panel 10, and/or increases the yield of the manufacturing of the display panel 10.

As shown in FIG. 7, a pixel PXL on an nth pixel row may be configured such that fourth and fifth TFTs T4 and T5 are turned on or off in response to the same emission signal EM(n), so as to simplify the pixel array. For this, a gate electrode of the fourth TFT T4 and a gate electrode of the fifth TFT T5 may be connected to an nth emission line, to which the nth emission signal EM(n) is applied. When the number of signal lines for supplying the gate signals decreases by removing some gate signals, an aperture ratio of the pixel can increase by a reduction in the number of signal lines. Further, the size of the gate driving circuit generating the gate signals may decrease by a reduction in the number of gate signals. This aids in the implementation of a narrow bezel.

As shown in FIG. 8, each pixel PXL of the display panel 10 may be configured such that a drain electrode of a second TFT T2 is connected to the input terminal of the low potential driving voltage ELVSS, so as to further simplify the pixel array. Because the initialization voltage Vinit is unnecessary in the pixel array including the pixels PXL shown in FIG. 8, signal lines for supplying the initialization voltage Vinit may be removed.

Since other components in the pixel PXL shown in FIGS. 7 and 8 are substantially the same as the pixel PXL shown in FIG. 3, a further description may be briefly made or may be entirely omitted.

Referring to FIG. 9, one frame period may be divided into an initial period Pi in which a node A and a node C are initialized, a sampling period Ps in which a threshold voltage Vth of a driving TFT DT is sampled and is stored in the node A, and an emission period Pe in which a gate-to-source voltage Vgs of the driving TFT DT is programmed to include the sampled threshold voltage Vth, and an OLED emits light using a driving current Ioled of the OLED controlled based on the programmed gate-to-source voltage Vgs.

In the initial period Pi, an nth first scan signal SCAN1(*n*) and an nth emission signal EM(n) are applied at an on-level, and an nth second scan signal SCAN2(*n*) is applied at an off-level. Since an operational effect obtained in the initial period Pi of FIG. 9 is substantially the same as the initial period Pi of FIG. 5A, a further description may be briefly made or may be entirely omitted.

In the sampling period Ps, the nth first scan signal SCAN1(*n*) and an nth second scan signal SCAN2(*n*) are applied at an on-level, and the nth emission signal EM(n) is applied at an off-level. Since an operational effect obtained in the sampling period Ps of FIG. 9 is substantially the same as the sampling period Ps of FIG. 5B, a further description may be briefly made or may be entirely omitted.

In the emission period Pe, the nth emission signal EM(n) is applied at an on-level, and the nth first scan signal SCAN1(*n*) and the nth second scan signal SCAN2(*n*) are applied at an off-level. Since an operational effect obtained in the emission period Pe of FIG. 9 is substantially the same as the emission period Pe of FIG. 5C, a further description may be briefly made or may be entirely omitted.

Figure 10:
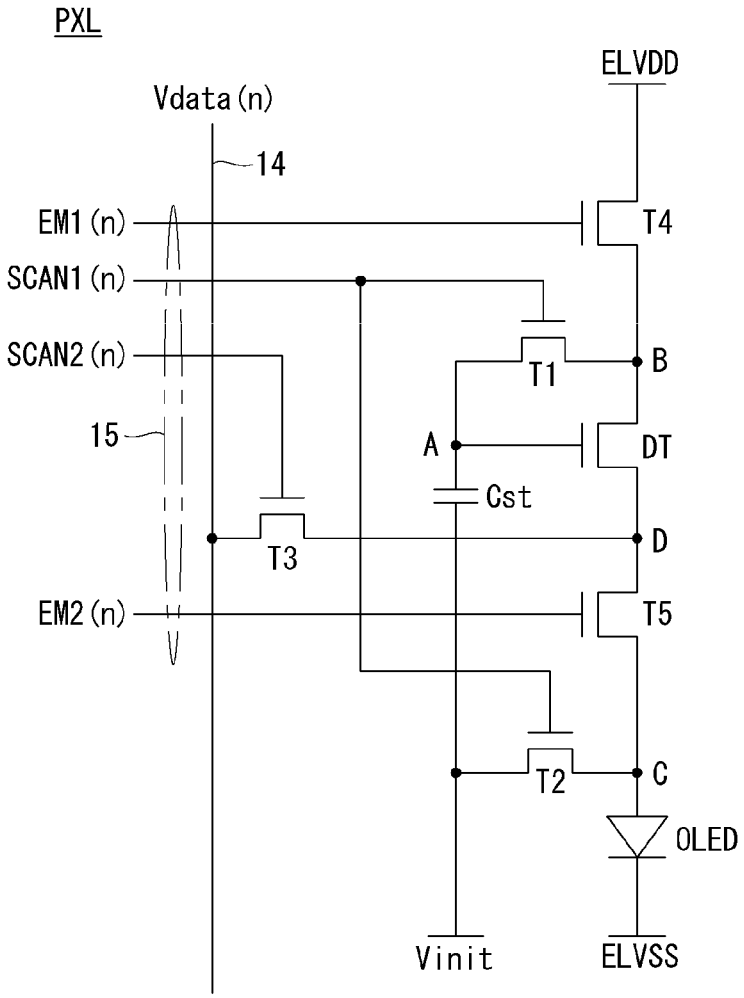
FIG. 10 is an equivalent circuit diagram showing a structure of a pixel according to an embodiment.
Figure 11:
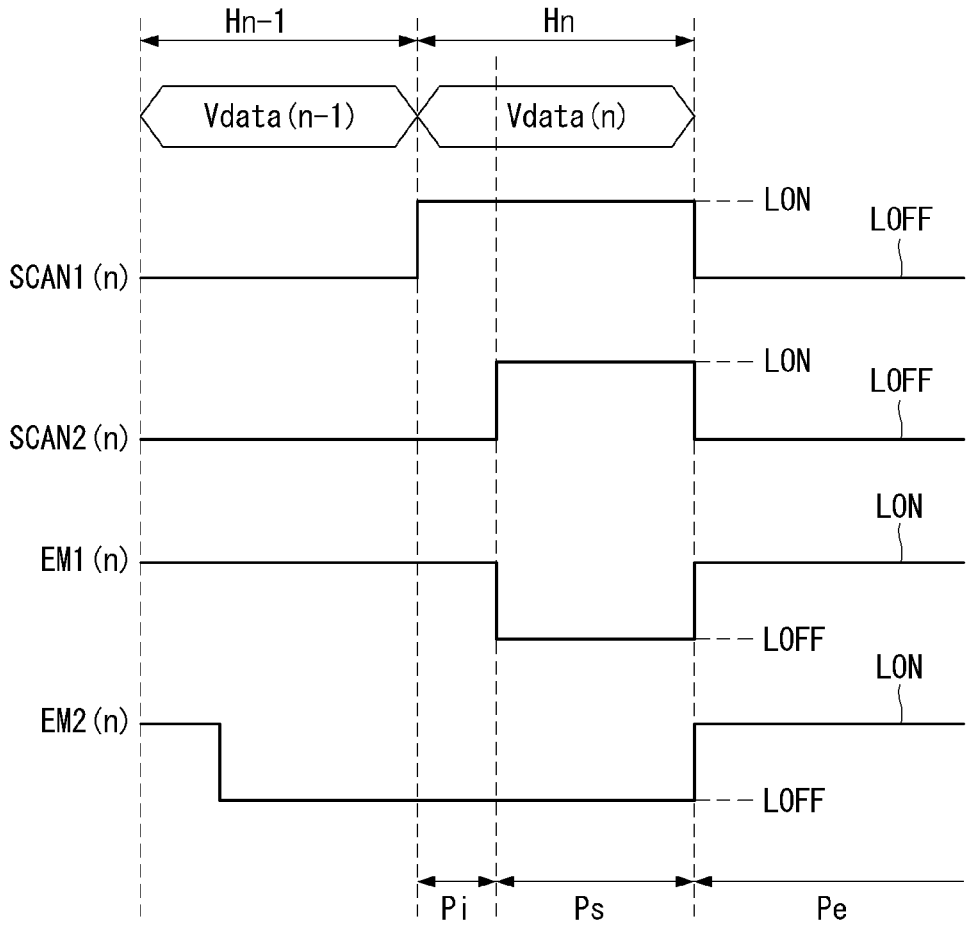
FIG. 11 is a waveform diagram showing a data signal and a gate signal applied to a pixel shown in FIG. 10.
Figure 12A:
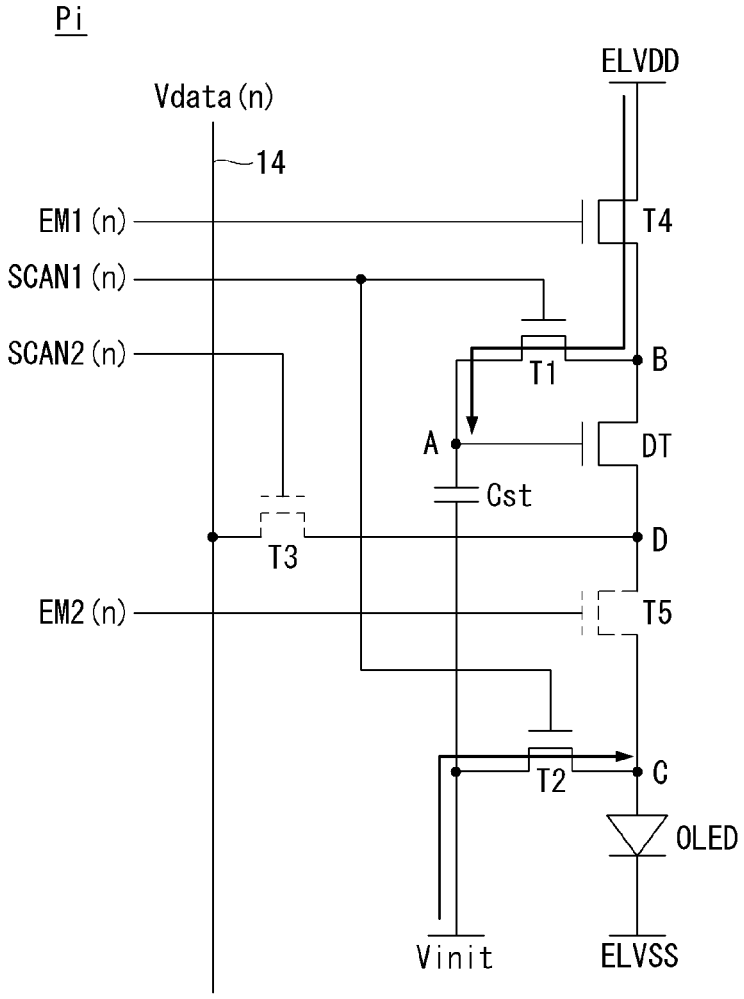
FIGS. 12A, 12B, and 12C respectively show equivalent circuit diagrams of a pixel corresponding to an initial period, a sampling period, and an emission period of FIG. 11.
Figure 12B:
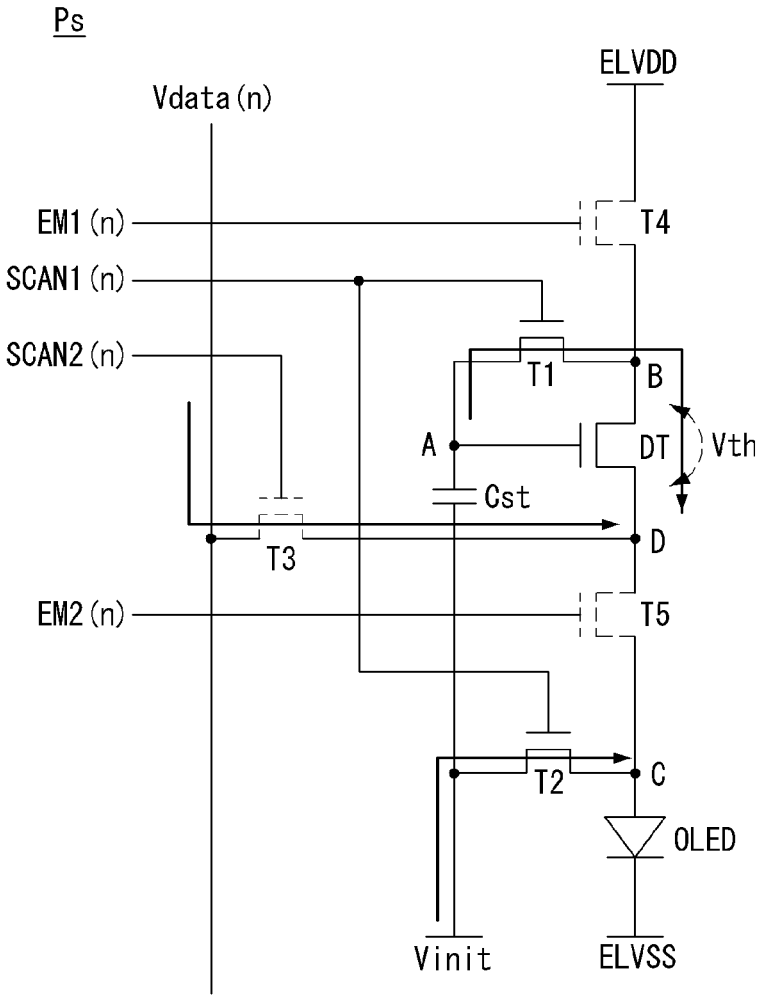
Figure 12C:
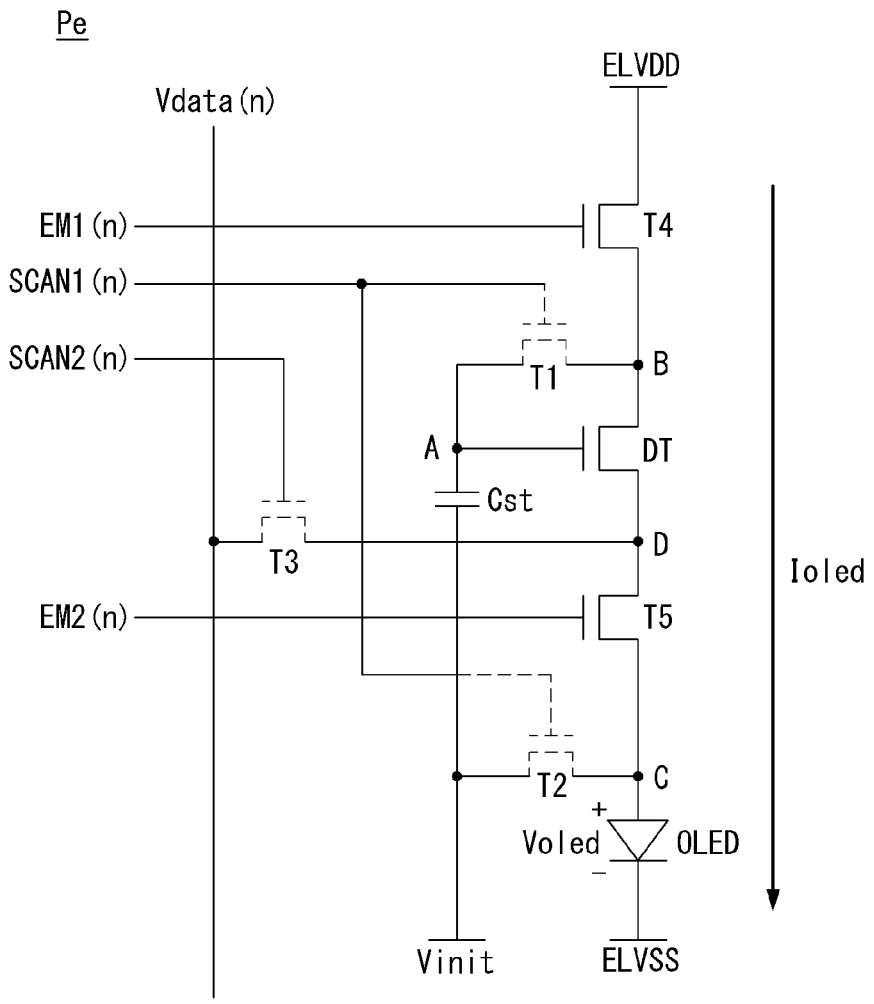

FIG. 10 is an equivalent circuit diagram showing a structure of a pixel according to an embodiment. FIG. 11 is a waveform diagram showing a data signal and a gate signal applied to a pixel shown in FIG. 10. FIGS. 12A, 12B, and 12C respectively show equivalent circuit diagrams of a pixel corresponding to an initial period, a sampling period, and an emission period of FIG. 11.

Referring to FIG. 10, each pixel PXL on an nth pixel row, where n is a natural number, includes an OLED, a driving TFT DT, a first TFT T1, a second TFT T2, a third TFT T3, a fourth TFT T4, a fifth TFT T5, and a storage capacitor Cst.

Configuration of the pixel PXL shown in FIG. 10 is substantially the same as configuration of the pixel PXL shown in FIG. 3, except a connection configuration of the storage capacitor Cst. In the pixel PXL shown in FIG. 10, the storage capacitor Cst is connected between a node A and the input terminal of the initialization voltage Vinit.

Referring to FIG. 11, one frame period may be divided into an initial period Pi in which a node A and a node C are initialized, a sampling period Ps in which a threshold voltage Vth of the driving TFT DT is sampled and is stored in the node A, and an emission period Pe in which a gate-to-source voltage Vgs of the driving TFT DT is programmed to include the sampled threshold voltage Vth, and an OLED emits light using a driving current Ioled of the OLED controlled based on the programmed gate-to-source voltage Vgs. As shown in FIG. 11, both an initialization operation and a sampling operation are performed during an nth horizontal period Hn. Namely, the initial period Pi and the sampling period Ps are included in the nth horizontal period Hn.

Referring to FIG. 12A, in the initial period Pi, an nth first scan signal SCAN1(*n*) and an nth first emission signal EM1(*n*) are applied at an on-level, and an nth second scan signal SCAN2(*n*) and an nth second emission signal EM2(*n*) are applied at an off-level. Since an operational effect obtained in the initial period Pi of FIG. 12A is substantially the same as the initial period Pi of FIG. 5A, a further description may be briefly made or may be entirely omitted.

Referring to FIG. 12B, in the sampling period Ps, the nth first scan signal SCAN1(*n*) and the nth second scan signal SCAN2(*n*) are applied at an on-level, and the nth first emission signal EM1(*n*) and the nth second emission signal EM2(*n*) are applied at an off-level. Since an operational effect obtained in the sampling period Ps of FIG. 12B is substantially the same as the sampling period Ps of FIG. 5B, a further description may be briefly made or may be entirely omitted.

The emission period Pe corresponds to a remaining period excluding the initial period Pi and the sampling period Ps from one frame period. Referring to FIG. 12C, in the emission period Pe, the nth first emission signal EM1(*n*) and the nth second emission signal EM2(*n*) are applied at an on-level, and the nth first scan signal SCAN1(*n*) and the nth second scan signal SCAN2(*n*) are applied at an off-level. Since an operational effect obtained in the emission period Pe of FIG. 12C is substantially the same as the emission period Pe of FIG. 5C, a further description may be briefly made or may be entirely omitted.

Figure 13:
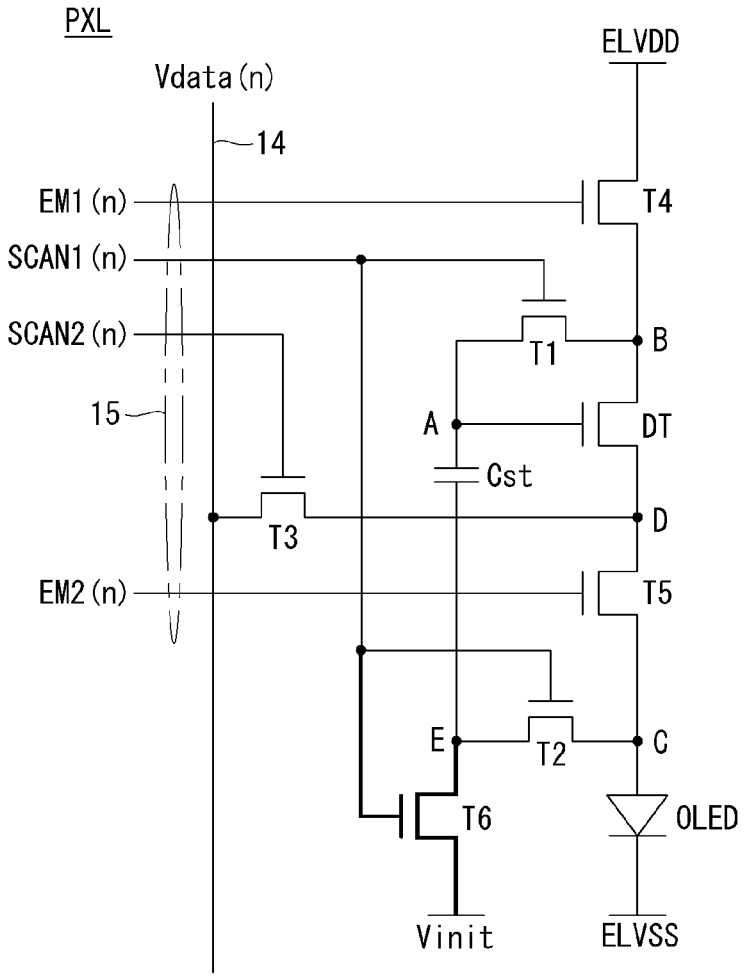
FIGS. 13 and 14 are equivalent circuit diagrams showing modified examples of a pixel structure shown in FIG. 10.
Figure 14:
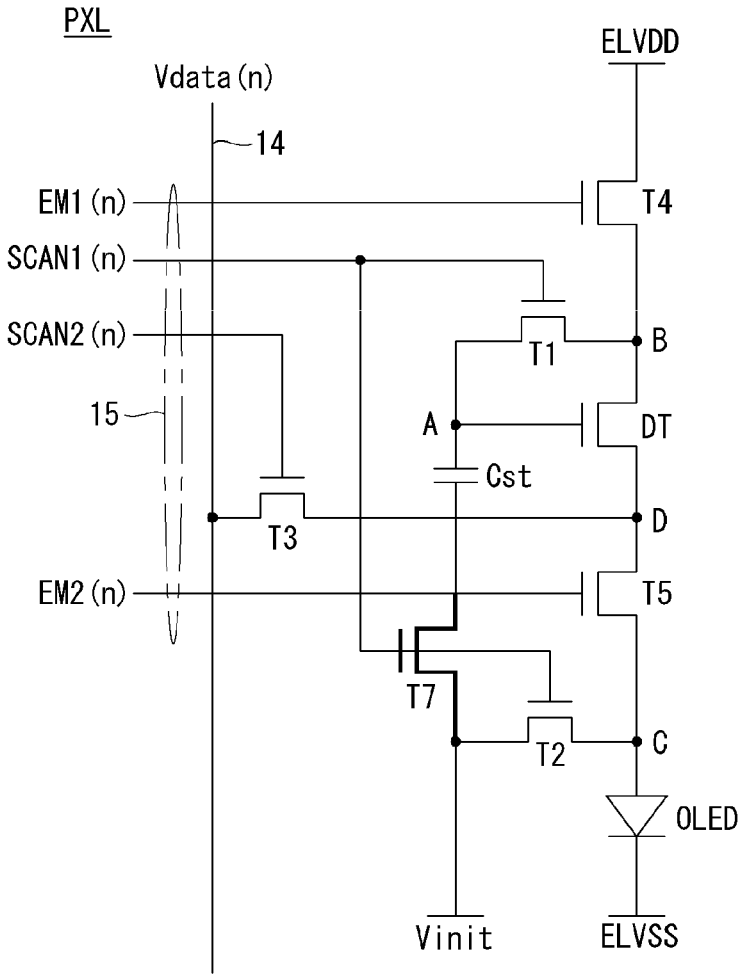

FIGS. 13 and 14 are equivalent circuit diagrams showing modified examples of a pixel structure shown in FIG. 10.

The pixel PXL of FIG. 13 is different from the pixel PXL of FIG. 10 in that the pixel PXL of FIG. 13 further includes a sixth TFT T6. In the pixel PXL of FIG. 13, a second TFT T2 is connected between a node E connected to a storage capacitor Cst and a node C, and the sixth TFT T6 is connected between the node E and the input terminal of the initialization voltage Vinit. A gate electrode of each of the second and sixth TFTs T2 and T6 is connected to an nth first scan line, to which the nth first scan signal SCAN1(*n*) is applied. The pixel PXL of FIG. 13 further includes the sixth TFT T6 and thus increases operational stability of a circuit. Since other components of the pixel PXL of FIG. 13 is substantially the same as the pixel PXL of FIG. 10, a further description may be briefly made or may be entirely omitted.

The pixel PXL of FIG. 14 is different from the pixel PXL of FIG. 10 in that the pixel PXL of FIG. 14 further includes a seventh TFT T7. In the pixel PXL of FIG. 14, the seventh TFT T7 is connected between a storage capacitor Cst and the input terminal of the initialization voltage Vinit. A gate electrode of each of the second and seventh TFTs T2 and T7 is connected to an nth first scan line, to which the nth first scan signal SCAN1(*n*) is applied. The pixel PXL of FIG. 14 further includes the seventh TFT T7 and thus increases the operational stability of a circuit. Since other components of the pixel PXL of FIG. 14 is substantially the same as the pixel PXL of FIG. 10, a further description may be briefly made or may be entirely omitted.

Figure 15:
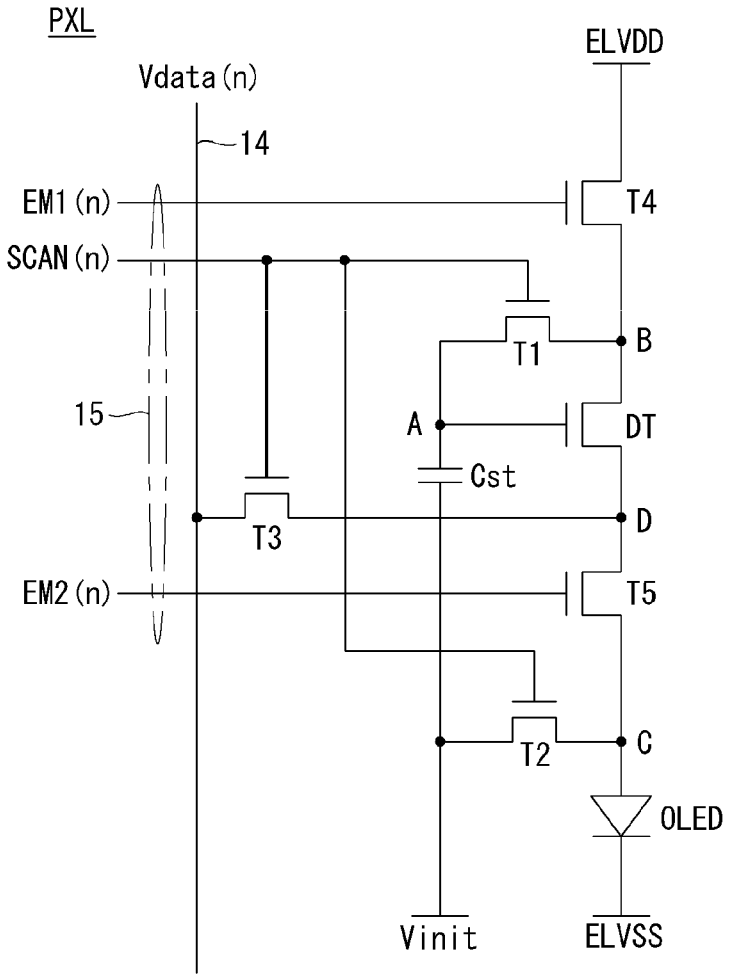
FIG. 15 is an equivalent circuit diagram showing another modified example of a pixel structure shown in FIG. 10.
Figure 16:
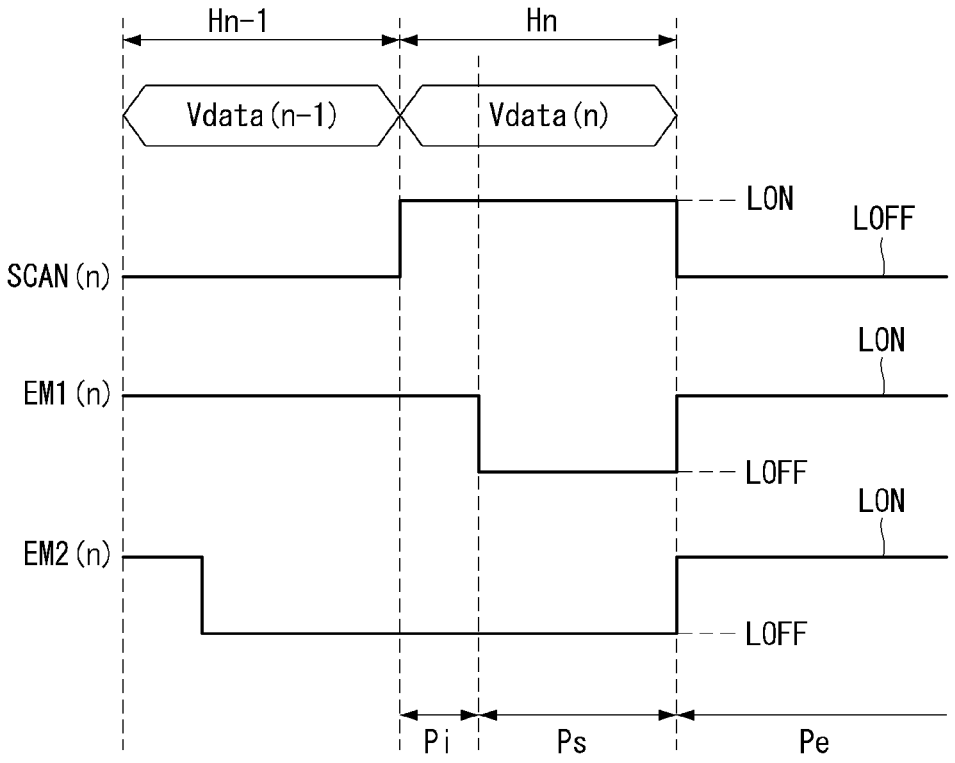
FIG. 16 is a waveform diagram showing a data signal and a gate signal applied to a pixel shown in FIG. 15.

FIG. 15 is an equivalent circuit diagram showing another modified example of a pixel structure shown in FIG. 10. FIG. 16 is a waveform diagram showing a data signal and a gate signal applied to a pixel shown in FIG. 15.

Simplifying a pixel array of the display panel 10 simplifies the manufacturing process of the display panel 10, and/or increases the yield of the manufacturing of the display panel 10.

As shown in FIG. 15, a pixel PXL on an nth pixel row may be configured such that second and third TFTs T2 and T3 are turned on or off in response to the same scan signal SCAN (n), so as to simplify the pixel array. For this, a gate electrode of the second TFT T2 and a gate electrode of the third TFT T3 may be connected to an nth scan line, to which the nth scan signal SCAN(n) is applied. When the number of signal lines for supplying the gate signals decreases by removing some gate signals, an aperture ratio of the pixel can increase by a reduction in the number of signal lines. Further, the size of the gate driving circuit generating the gate signals may decrease by a reduction in the number of gate signals. This is aids in the implementation of a narrow bezel.

Since other components in the pixel PXL shown in FIG. 15 are substantially the same as the pixel PXL shown in FIG. 10, a further description may be briefly made or may be entirely omitted.

Referring to FIG. 16, one frame period may be divided into an initial period Pi in which a node C is initialized, a sampling period Ps in which a threshold voltage Vth of a driving TFT DT is sampled and is stored in a node A, and an emission period Pe in which a gate-to-source voltage Vgs of the driving TFT DT is programmed to include the sampled threshold voltage Vth, and an OLED emits light using a driving current Ioled of the OLED controlled based on the programmed gate-to-source voltage Vgs.

In the initial period Pi, an nth scan signal SCAN(n) and an nth first emission signal EM1(*n*) are applied at an on-level, and an nth second emission signal EM2(*n*) is applied at an off-level. Since an operational effect obtained in the initial period Pi of FIG. 16 is substantially the same as the initial period Pi of FIG. 12A, a further description may be briefly made or may be entirely omitted.

In the sampling period Ps, the nth scan signal SCAN(n) is applied at an on-level, and the nth first emission signal EM1(*n*) and the nth second emission signal EM2(*n*) are applied at an off-level. Since an operational effect obtained in the sampling period Ps of FIG. 16 is substantially the same as the sampling period Ps of FIG. 12B, a further description may be briefly made or may be entirely omitted.

In the emission period Pe, the nth first emission signal EM1(*n*) and the nth second emission signal EM2(*n*) are applied at an on-level, and the nth scan signal SCAN(n) is applied at an off-level. Since an operational effect obtained in the emission period Pe of FIG. 16 is substantially the same as the emission period Pe of FIG. 12C, a further description may be briefly made or may be entirely omitted.

Figure 17:
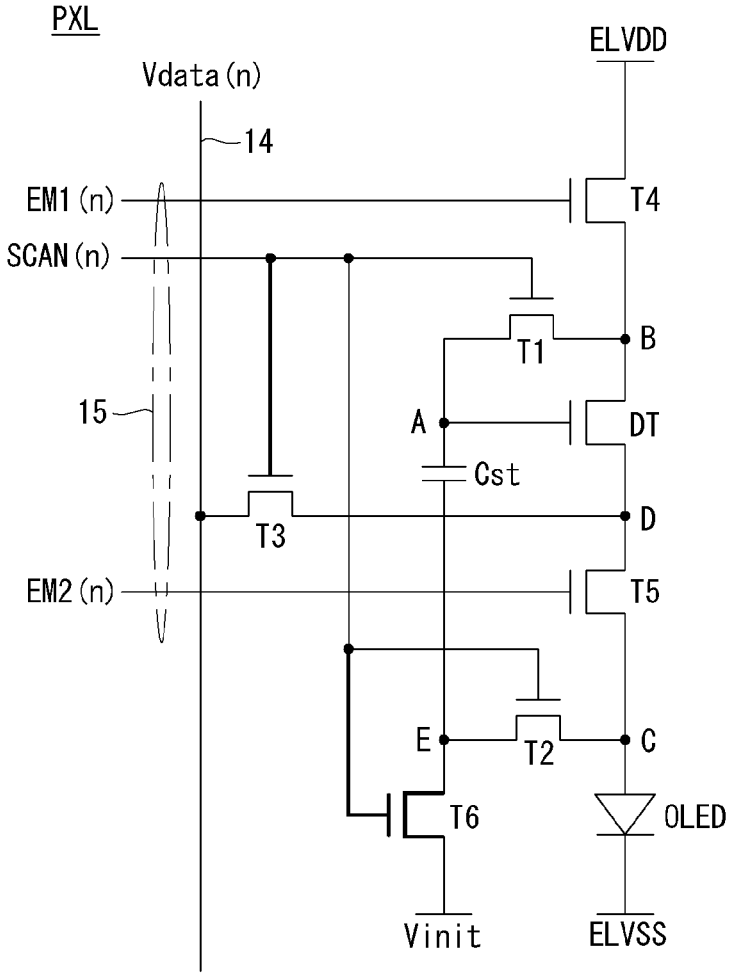
FIGS. 17 and 18 are equivalent circuit diagrams showing other modified examples of a pixel structure shown in FIG. 15.
Figure 18:
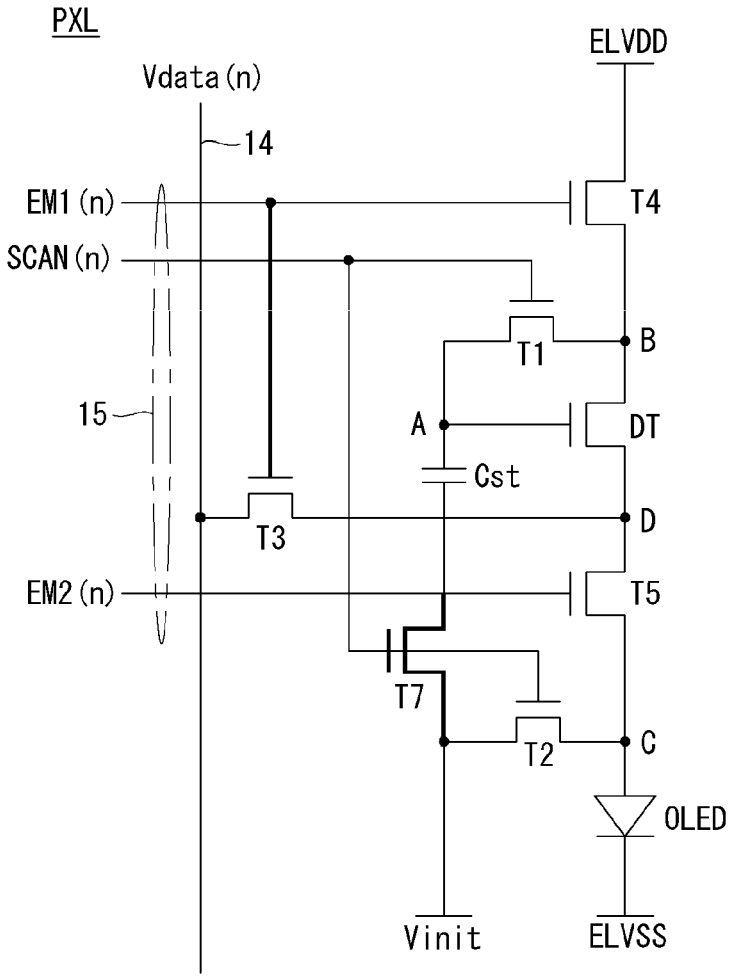

FIGS. 17 and 18 are equivalent circuit diagrams showing other modified examples of a pixel structure shown in FIG. 15.

The pixel PXL of FIG. 17 is different from the pixel PXL of FIG. 15 in that the pixel PXL of FIG. 17 further includes a sixth TFT T6. In the pixel PXL of FIG. 17, a second TFT T2 is connected between a node E connected to a storage capacitor Cst and a node C, and the sixth TFT T6 is connected between the node E and the input terminal of the initialization voltage Vinit. A gate electrode of each of the second and sixth TFTs T2 and T6 is connected to an nth scan line, to which the nth scan signal SCAN(n) is applied. The pixel PXL of FIG. 17 further includes the sixth TFT T6 and thus increases the operational stability of a circuit. Since other components of the pixel PXL of FIG. 17 is substantially the same as the pixel PXL of FIG. 15, a further description may be briefly made or may be entirely omitted.

The pixel PXL of FIG. 18 is different from the pixel PXL of FIG. 15 in that the pixel PXL of FIG. 18 further includes a seventh TFT T7. In the pixel PXL of FIG. 18, the seventh TFT T7 is connected between a storage capacitor Cst and the input terminal of the initialization voltage Vinit. A gate electrode of each of the second and seventh TFTs T2 and T7 is connected to an nth scan line, to which the nth scan signal SCAN(n) is applied. The pixel PXL of FIG. 18 further includes the seventh TFT T7 and thus increases the operational stability of a circuit. Since other components of the pixel PXL of FIG. 18 is substantially the same as the pixel PXL of FIG. 15, a further description may be briefly made or may be entirely omitted.

Figure 19:
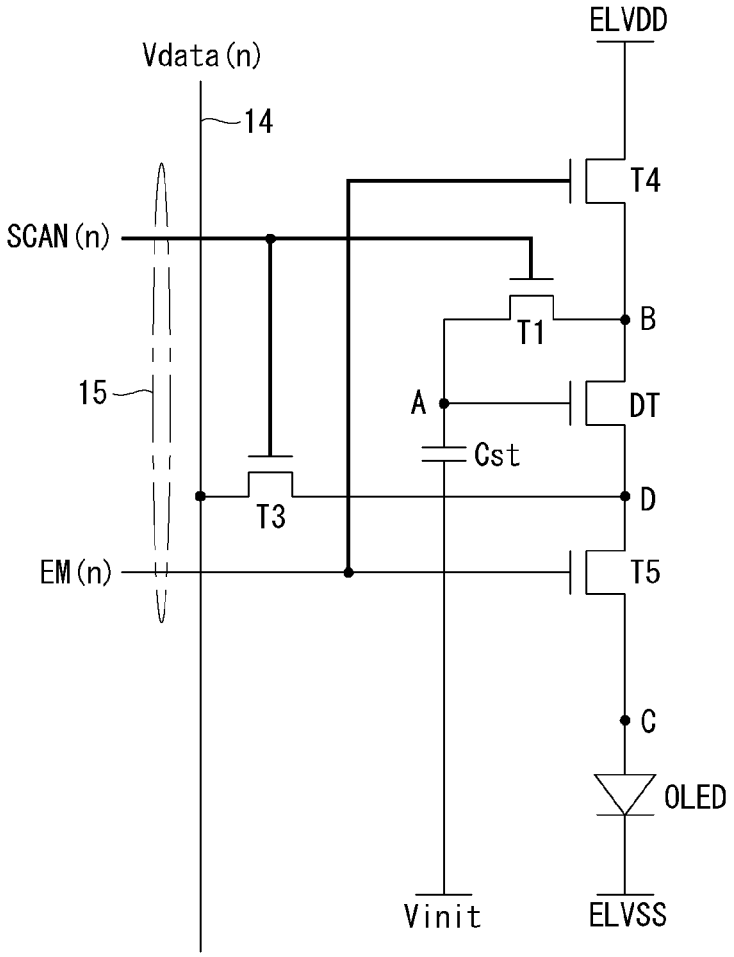
FIGS. 19 and 20 are equivalent circuit diagrams showing a structure of a pixel according to an embodiment.
Figure 20:
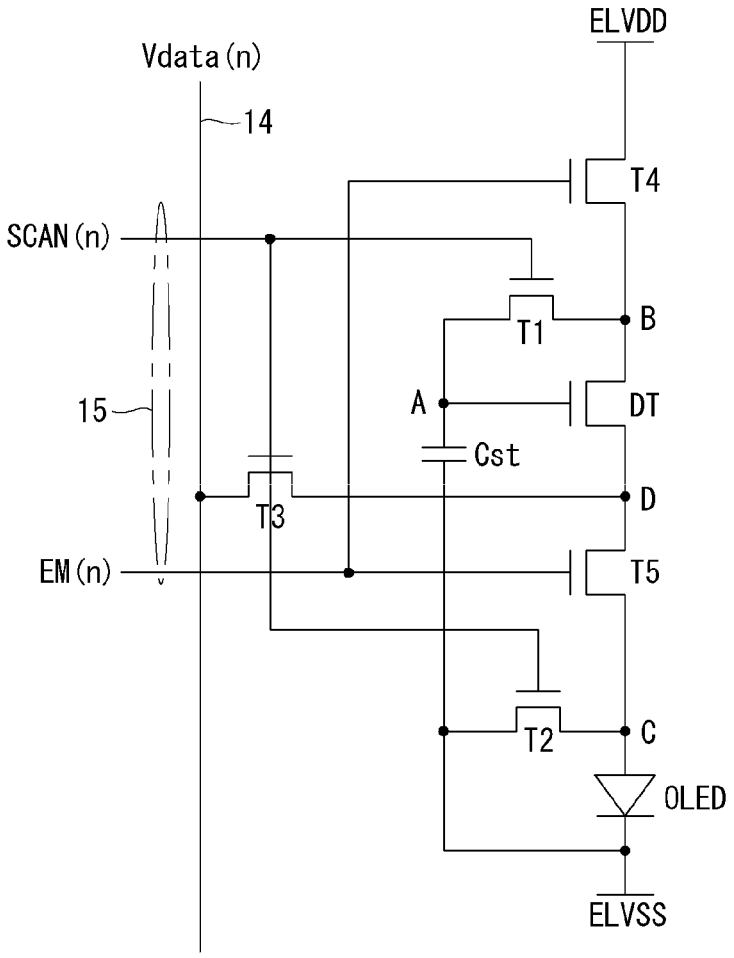
Figure 21:
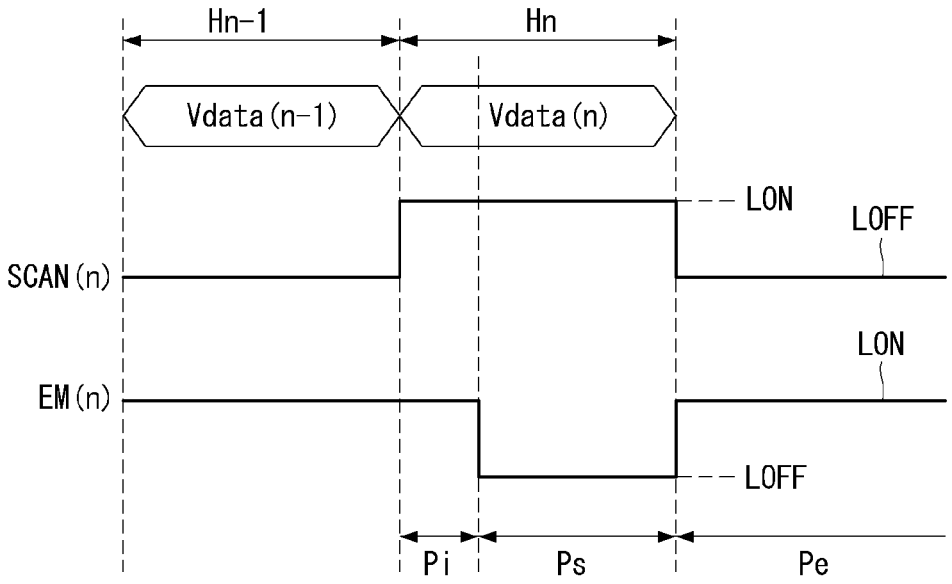
FIG. 21 is a waveform diagram showing a data signal and a gate signal applied to a pixel shown in FIGS. 19 and 20.

FIGS. 19 and 20 are equivalent circuit diagrams showing a structure of a pixel according to an embodiment. FIG. 21 is a waveform diagram showing a data signal and a gate signal applied to a pixel shown in FIGS. 19 and 20.

Referring to FIG. 19, each pixel PXL on an nth pixel row, where n is a natural number, includes an OLED, a driving TFT DT, a first TFT T1, a third TFT T3, a fourth TFT T4, a fifth TFT T5, and a storage capacitor Cst. The pixel PXL of FIG. 19 is different from the pixel PXL of FIG. 10, in that the pixel PXL of FIG. 19 does not include a second TFT T2, the first and third TFTs T1 and T3 are driven using the same scan signal SCAN(n), and the fourth and fifth TFTs T4 and T5 are driven using the same emission signal EM(n). Because the pixel structure of FIG. 19 has the minimum number of TFTs and the minimum number of gate signals compared to the above-described pixel structures, the pixel structure of FIG. 19 is most advantageous to increase the integration. In the pixel PXL of FIG. 19, the storage capacitor Cst is connected between a node A and the input terminal of the initialization voltage Vinit.

A pixel PXL of FIG. 20 includes a second TFT T2 connected between a node C and the input terminal of the low potential driving voltage ELVSS, unlike the pixel PXL of FIG. 19. In the pixel PXL of FIG. 20, the storage capacitor Cst is connected between a node A and the input terminal of the low potential driving voltage ELVSS.

The pixel PXL of FIG. 20 further includes the second TFT T2 so as to initialize the node C in an initial period Pi, thereby securing the operational stability. In the pixel PXL of FIG. 20, because a drain electrode of the second TFT T2 is directly connected to the input terminal of the low potential driving voltage ELVSS, signal lines for supplying the initialization voltage Vinit may be removed.

Referring to FIG. 21, one frame period may be divided into an initial period Pi in which a node A and a node C are initialized, a sampling period Ps in which a threshold voltage Vth of the driving TFT DT is sampled and is stored in the node A, and an emission period Pe in which a gate-to-source voltage Vgs of the driving TFT DT is programmed to include the sampled threshold voltage Vth, and an OLED emits light using a driving current Ioled of the OLED controlled based on the programmed gate-to-source voltage Vgs. As shown in FIG. 21, both an initialization operation and a sampling operation are performed during an nth horizontal period Hn. Namely, the initial period Pi and the sampling period Ps are included in the nth horizontal period Hn.

In the initial period Pi, an nth scan signal SCAN(n) and an nth emission signal EM(n) are applied at an on-level. Since an operational effect obtained in the initial period Pi of FIG. 21 is substantially the same as the initial period Pi of FIG. 12A, a further description may be briefly made or may be entirely omitted.

In the sampling period Ps, the nth scan signal SCAN(n) is applied at an on-level, and the nth emission signal EM(n) is applied at an off-level. Since an operational effect obtained in the sampling period Ps of FIG. 21 is substantially the same as the sampling period Ps of FIG. 12B, a further description may be briefly made or may be entirely omitted.

In the emission period Pe, the nth emission signal EM(n) is applied at an on-level, and the nth scan signal SCAN(n) is applied at an off-level. Since an operational effect obtained in the emission period Pe of FIG. 21 is substantially the same as the emission period Pe of FIG. 12C, a further description may be briefly made or may be entirely omitted.

Figure 22:
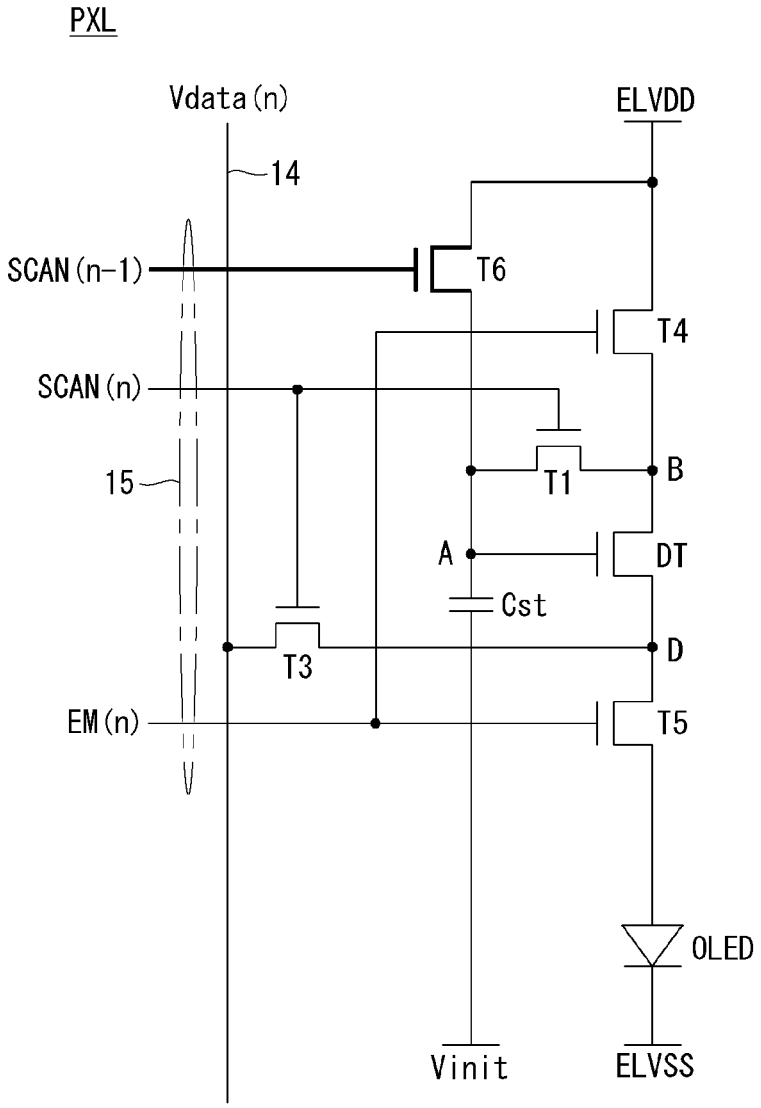
FIGS. 22 to 24 are equivalent circuit diagrams showing modified examples of a pixel structure shown in FIGS. 19 and 20.
Figure 23:
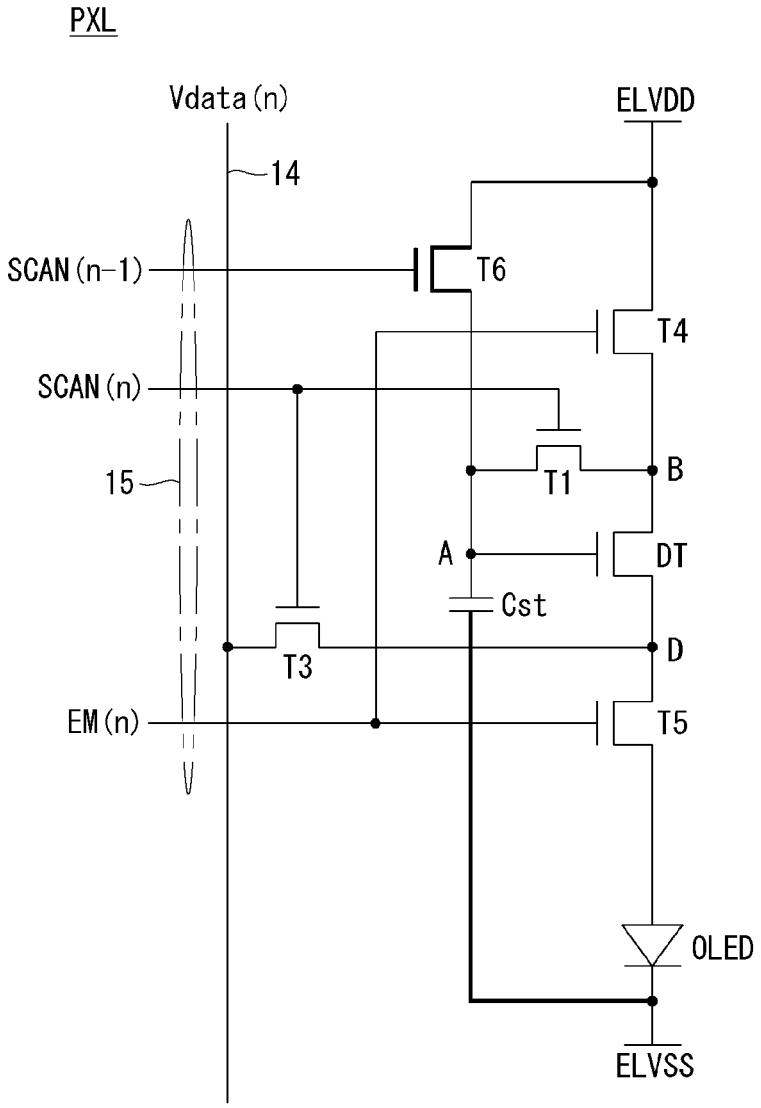
Figure 25:
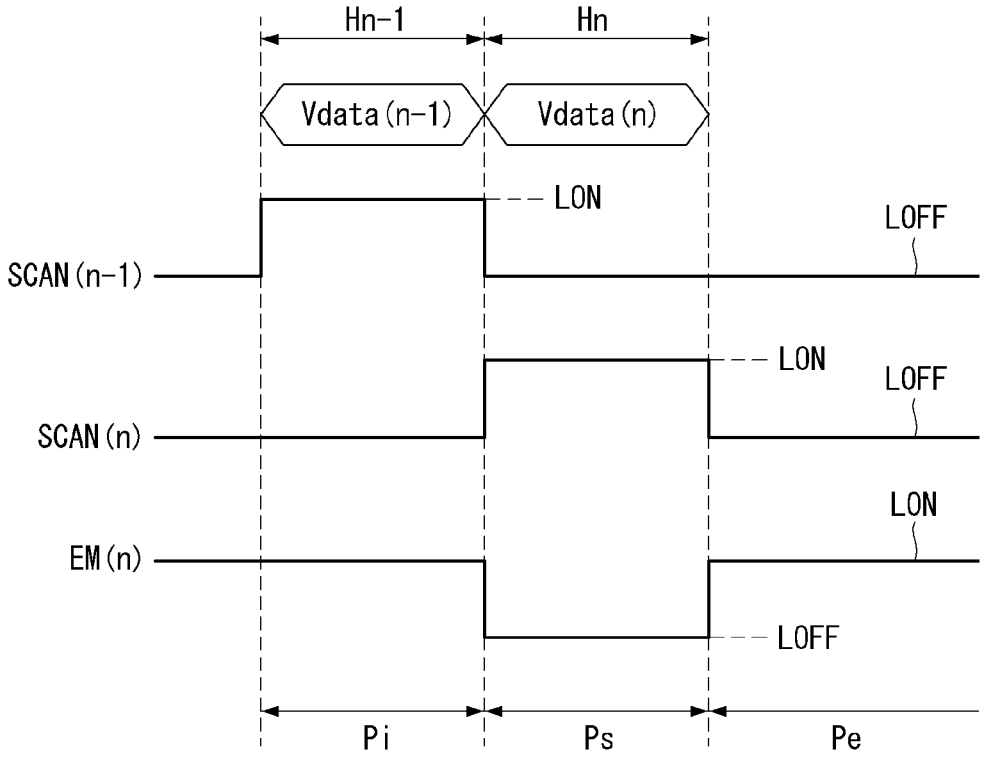
FIG. 25 is a waveform diagram showing a data signal and a gate signal applied to a pixel shown in FIGS. 22 to 24.

FIGS. 22 to 24 are equivalent circuit diagrams showing modified examples of a pixel structure shown in FIGS. 19 and 20. FIG. 25 is a waveform diagram showing a data signal and a gate signal applied to a pixel shown in FIGS. 22 to 24.

A pixel PXL of FIG. 22 further includes a sixth TFT T6 compared to the pixel PXL of FIG. 19, and a pixel PXL of FIG. 24 further includes a sixth TFT T6 compared to the pixel PXL of FIG. 20. The sixth TFT T6 includes a drain electrode connected to the input terminal of the high potential driving voltage ELVDD and a source electrode connected to a node A. A gate electrode of the sixth TFT T6 is connected to a (n−1)th scan line, to which a (n−1)th scan signal SCAN(n−1) is applied, so that an initialization operation is performed in a (n−1)th horizontal period Hn−1. As a result, as shown in FIG. 25, because an entire duration of an nth horizontal period Hn is allotted to a sampling operation of the pixels PXL of FIGS. 22 and 24, a sampling period Ps can be sufficiently secured, and reliability of the sampling operation can be improved.

A pixel PXL of FIG. 23 is different from the pixel PXL of FIG. 22 in that an electrode on one side of a storage capacitor Cst is directly connected to the input terminal of the low potential driving voltage ELVSS. Hence, the pixel PXL of FIG. 23 can remove signal lines for supplying the initialization voltage Vinit.

In one of the pixels PXL shown in FIGS. 22 to 24, a gate electrode of each of the first, second, and third TFTs T1, T2, and T3 is connected to an nth scan line to which an nth scan signal SCAN(n) is applied; a gate electrode of each of the fourth and fifth TFTs T4 and T5 is connected to an nth emission line to which an nth emission signal EM(n) is applied; and a gate electrode of the sixth TFT T6 is connected to the (n−1)th scan line, to which the (n−1)th scan signal SCAN(n−1) is applied.

In an initial period Pi, the (n−1)th scan signal SCAN(n−1) and the nth emission signal EM(n) are applied at an on-level, and the nth scan signal SCAN(n) is applied at an off-level. In a sampling period Ps, the nth scan signal SCAN(n) is applied at an on-level, and the (n−1)th scan signal SCAN (n−1) and the nth emission signal EM(n) are applied at an off-level. In an emission period Pe, the nth emission signal EM(n) is applied at an on-level, and the (n−1)th scan signal SCAN(n−1) and the nth emission signal EM(n) are applied at an off-level.

The initial period Pi is included in a (n−1)th horizontal period Hn−1, and the sampling period Ps is included in an nth horizontal period Hn.

Figure 26:
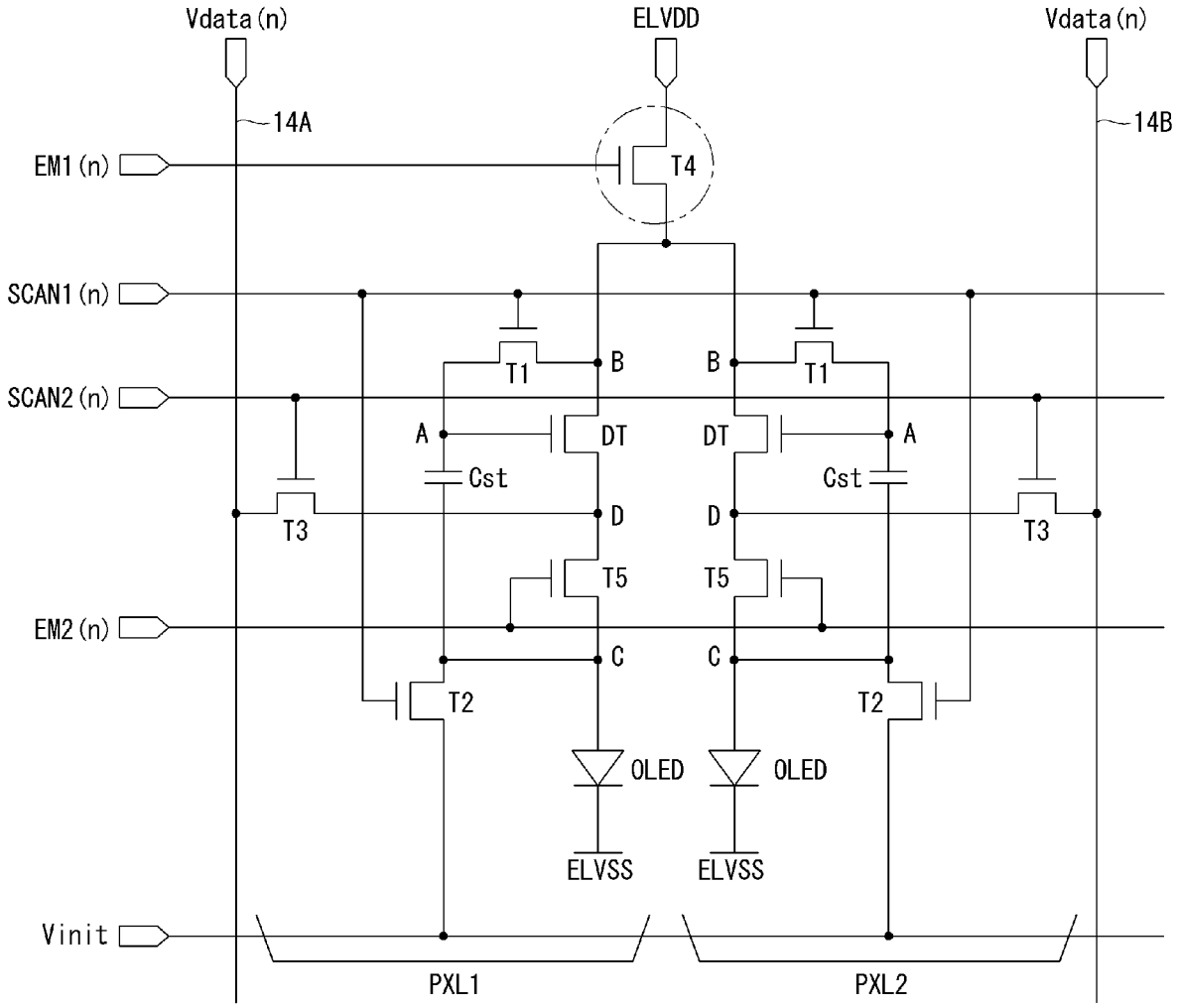
FIGS. 26 to 28 are equivalent circuit diagrams showing an example where horizontally adjacent pixels share a predetermined thin film transistor with each other.
Figure 27:
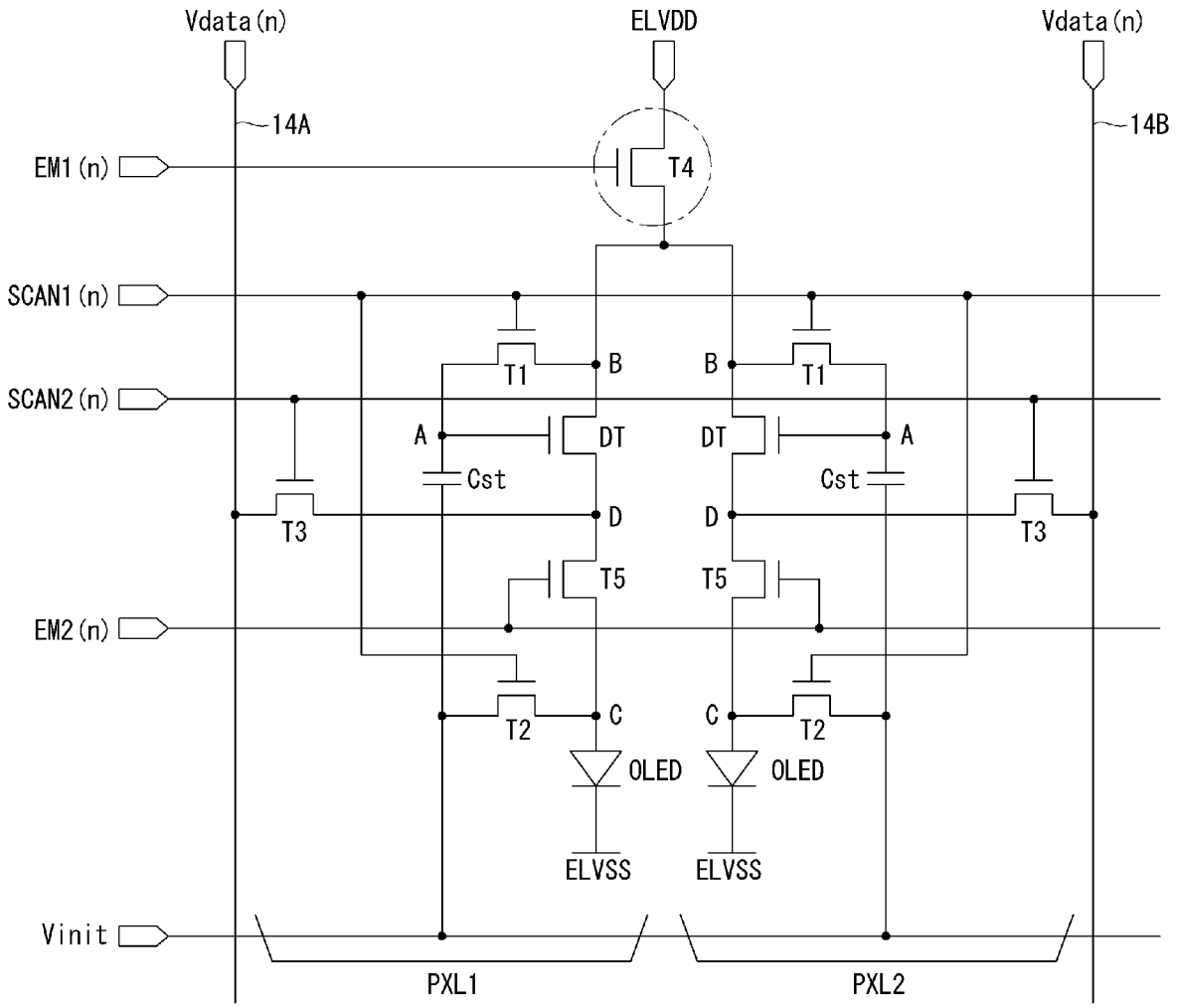
Figure 28:
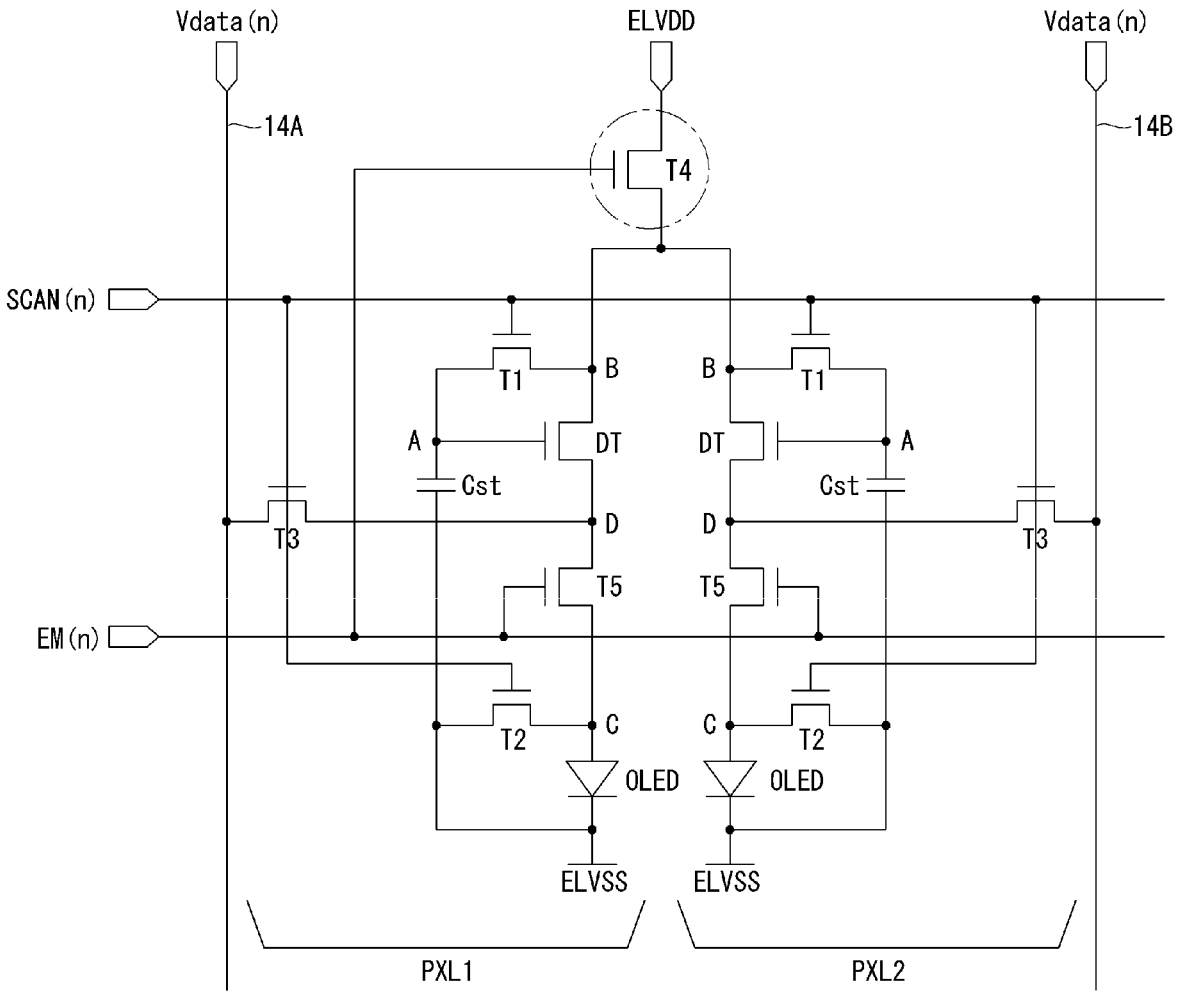

FIGS. 26 to 28 are equivalent circuit diagrams showing an example where horizontally adjacent pixels share a predetermined TFT with each other so as to increase the integration of pixels.

FIG. 26 illustrates a sharing structure based on the pixel structure of FIG. 3, FIG. 27 illustrates a sharing structure based on the pixel structure of FIG. 10, and FIG. 28 illustrates a sharing structure based on the pixel structure of FIG. 20.

In FIGS. 26 to 28, horizontally adjacent pixels PXL1 and PXL2 include a first pixel PXL1 connected to a first data line 14A and a second pixel PXL2 connected to a second data line 14B adjacent to the first data line 14A. In this instance, the first and second pixels PXL1 and PXL2 may share a fourth TFT T4, that is directly connected to the input terminal of the high potential driving voltage ELVDD, with each other, so as to increase the integration of the pixels. Hence, the embodiments can reduce the number of fourth TFTs T4 in the pixel array to one half through the sharing structure.

Although embodiments have been described with reference to a number of illustrative embodiments thereof, it should be understood that numerous other modifications and embodiments can be devised by those skilled in the art that will fall within the scope of the principles of this disclosure. More particularly, various variations and modifications are possible in the component parts and/or arrangements of the subject combination arrangement within the scope of the disclosure, the drawings and the appended claims. In addition to variations and modifications in the component parts and/or arrangements, alternative uses will also be apparent to those skilled in the art.

What is claimed is:

1. A light emitting diode display comprising:

a display panel including a plurality of pixels, the pixels including a pixel that comprises:

a light emitting diode including an anode electrode connected to a node C and a cathode electrode connected to an input terminal of a low potential driving voltage;

a driving thin film transistor (TFT) including a gate electrode connected to a node A, a drain electrode connected to a node B, and a source electrode connected to a node D, the driving TFT controlling a driving current applied to the light emitting diode;

a first TFT connected between the node A and the node B;

a second TFT connected to the node C;

a third TFT connected between a data line and the node D;

a fourth TFT connected between an input terminal of a high potential driving voltage and the node B;

a fifth TFT connected between the node D and the node C;

a storage capacitor connected between the node A and an input terminal of an initialization voltage; and a seventh TFT connected between the storage capacitor and the input terminal of the initialization voltage, wherein a gate electrode of each of the first, second, and seventh TFTs is connected to a first scan line to which a first scan signal is applied, a gate electrode of the third TFT is connected to a second scan line to which a second scan signal is applied, a gate electrode of the fourth TFT is connected to a first emission line to which a first emission signal is applied, and a gate electrode of the fifth TFT is connected to a second emission line to which a second emission signal is applied, wherein one frame period includes an initial period in which the node A and the node C are initialized, a sampling period in which a threshold voltage of the driving TFT is sampled and is stored in the node A, and an emission period in which a gate-to-source voltage of the driving TFT is programmed to include the sampled threshold voltage and the light emitting diode emits light using the driving current controlled based on the programmed gate-to-source voltage, wherein in the initial period, the first scan signal and the first emission signal are applied at an on-level, and the second scan signal and the second emission signal are applied at an off-level, wherein in the sampling period, the first scan signal and the second scan signal are applied at an on-level, and the first emission signal and the second emission signal are applied at an off-level, and wherein in the emission period, the first emission signal and the second emission signal are applied at an on-level, and the first scan signal and the second scan signal are applied at an off-level.

2. The light emitting diode display of claim 1, wherein the second TFT is further connected to the input terminal of the initialization voltage.

3. The light emitting diode display of claim 1, wherein the pixel is part of an nth pixel row, wherein n is a natural number, and wherein the initial period and the sampling period are performed while a data signal for the nth pixel row is provided to the data line.

4. The light emitting diode display of claim 1, wherein at least one of the first TFT and the second TFT comprises two serially connected TFTs turned on or off in response to a same scan signal.

* * * * *